US011753932B2

(12) United States Patent
Sauthoff

(10) Patent No.: US 11,753,932 B2
(45) Date of Patent: Sep. 12, 2023

(54) ANGLE-DEPENDING VALVE RELEASE UNIT FOR SHEAR VALVE PULSER

(71) Applicant: Bastian Sauthoff, Burgdorf (DE)

(72) Inventor: Bastian Sauthoff, Burgdorf (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 38 days.

(21) Appl. No.: 17/336,815

(22) Filed: Jun. 2, 2021

(65) Prior Publication Data

US 2021/0372278 A1 Dec. 2, 2021

Related U.S. Application Data

(60) Provisional application No. 63/033,532, filed on Jun. 2, 2020.

(51) Int. Cl.
*E21B 47/18* (2012.01)
*E21B 34/06* (2006.01)

(52) U.S. Cl.
CPC ..... *E21B 47/18* (2013.01); *E21B 34/06* (2013.01)

(58) Field of Classification Search
CPC ..... E21B 47/12; E21B 47/14; E21B 47/18; E21B 47/20; E21B 47/24; E21B 34/06
See application file for complete search history.

(56) References Cited

U.S. PATENT DOCUMENTS 2,911,192 A 11/1959 Boucher
2,964,116 A 12/1960 Peterson
2,973,505 A 2/1961 Johannesen
(Continued)

FOREIGN PATENT DOCUMENTS

CN 1466693 A 1/2004
EP 0140788 A2 5/1985
(Continued)

OTHER PUBLICATIONS

Carter, Joseph Alan; "Experimental and Theoretical Study of Mud Pulse Propagation: A Thesis"; Graduate Faculty of the Lousiana State University and Agricultural and Mechanical College Department of Petroleum Engineering; May 1986; 74 Pages.
(Continued)

*Primary Examiner* — Franklin D Balseca
(74) *Attorney, Agent, or Firm* — CANTOR COLBURN LLP

(57) ABSTRACT

Systems and methods for generating pulses in a drilling fluid are described. The systems are configured to be positioned along a tubular string through which a drilling fluid flows. The systems include a housing supported along the string. A valve stator is supported by the housing and has at least one flow path that extends from an upstream end to a downstream end of the valve stator. A valve rotor is positioned adjacent the valve stator and configured to selectively obstruct the at least one flow path. An axial gap is present between the valve rotor and the valve stator. A motor is coupled to the valve rotor to rotate the valve rotor relative to the valve stator and an axial release assembly having a rotational element is configured to adjust the axial gap between the valve rotor and the valve stator based on a rotation of the rotational element.

19 Claims, 13 Drawing Sheets

(56) References Cited

U.S. PATENT DOCUMENTS 3,065,416 A 11/1962 Jeter
3,302,457 A 2/1967 Mayes
3,309,656 A 3/1967 Godbey
3,507,341 A 4/1970 Basgan
3,693,428 A 9/1972 Le Peuvedic et al.
3,713,089 A 1/1973 Clacomb
3,723,728 A 3/1973 Von Hayn
3,736,558 A 5/1973 Cubberly, Jr.
3,764,968 A 10/1973 Anderson
3,958,217 A 5/1976 Spinnler
3,983,948 A 10/1976 Jeter
RE29,734 E * 8/1978 Manning ..... E21B 47/18 175/232
4,351,037 A 9/1982 Scherbatskoy
4,491,738 A 1/1985 Kamp
4,643,654 A 2/1987 Rinder
4,785,300 A 11/1988 Chin et al.
4,847,815 A 7/1989 Malone
4,903,245 A 2/1990 Close et al.
4,914,637 A 4/1990 Goodsman
4,953,595 A 9/1990 Kotlyar
5,073,877 A 12/1991 Jeter
5,106,263 A 4/1992 Irie
5,117,398 A 5/1992 Jeter
5,119,344 A 6/1992 Innes
5,182,731 A 1/1993 Hoelscher
5,189,645 A 2/1993 Innes
5,215,152 A 6/1993 Duckworth
5,249,161 A 9/1993 Jones et al.
5,311,952 A 5/1994 Eddison et al.
5,357,483 A 10/1994 Innes
5,375,098 A 12/1994 Malone et al.
5,473,579 A 12/1995 Jeter
5,477,923 A 12/1995 Jordan, Jr. et al.
5,517,464 A 5/1996 Lerner et al.
5,546,359 A 8/1996 Aarseth
5,583,827 A * 12/1996 Chin ..... E21B 47/18 367/148
5,586,083 A 12/1996 Chin et al.
5,636,178 A 6/1997 Ritter
5,660,238 A 8/1997 Earl et al.
5,740,126 A 4/1998 Chin et al.
5,787,052 A 7/1998 Gardner et al.
5,812,068 A 9/1998 Wisler et al.
5,957,220 A 9/1999 Coffman et al.
5,963,138 A 10/1999 Gruenhagen
6,016,288 A 1/2000 Frith
6,050,348 A 4/2000 Richardson et al.
6,097,310 A 8/2000 Harrell et al.
6,219,301 B1 4/2001 Moriarty
6,250,880 B1 6/2001 Woodard et al.
6,469,637 B1 10/2002 Seyler et al.
6,484,817 B2 11/2002 Innes
6,555,926 B2 4/2003 Gondron
6,577,244 B1 6/2003 Clark et al.
6,623,475 B1 9/2003 Siess
6,626,253 B2 9/2003 Hahn et al.
6,714,138 B1 3/2004 Turner et al.
6,836,218 B2 12/2004 Frey et al.
6,896,050 B2 5/2005 Biglin, Jr. et al.
6,903,660 B2 6/2005 Clark et al.
6,970,398 B2 11/2005 Lavrut et al.
6,975,243 B2 12/2005 Clark et al.
6,975,244 B2 12/2005 Hahn et al.
6,995,684 B2 2/2006 Clark
7,011,156 B2 3/2006 Von Gynz-Rekowski
7,083,008 B2 8/2006 Thorp et al.
7,133,325 B2 11/2006 Kotsonis et al.
7,187,297 B2 3/2007 Clark et al.
7,230,880 B2 6/2007 Lehr
7,320,370 B2 1/2008 Virally et al.
7,327,634 B2 2/2008 Perry et al.
7,347,283 B1 3/2008 Sharp et al.
7,380,616 B2 6/2008 Virally et al.
7,417,920 B2 8/2008 Hahn et al.
7,423,932 B1 9/2008 Jeter
7,428,922 B2 9/2008 Fripp et al.
7,431,688 B2 10/2008 Wampler et al.
RE40,944 E 10/2009 Seyler et al.
10,246,995 B2 * 4/2019 Huber ..... E21B 34/08
11,371,326 B2 * 6/2022 Riachentsev ..... E21B 43/128
11,486,477 B2 * 11/2022 Huynh ..... G01L 5/0061
2013/0277119 A1 10/2013 Rogers et al.
2014/0026428 A1 1/2014 Barnes
2015/0233237 A1 8/2015 Logan et al.
2015/0233238 A1 8/2015 Logan et al.
2015/0247403 A1 9/2015 Logan et al.
2015/0267534 A1 9/2015 Gosney et al.
2015/0275660 A1 10/2015 Logan et al.
2015/0292322 A1 10/2015 Logan et al.
2015/0300160 A1 10/2015 Logan et al.
2015/0322779 A1 11/2015 Logan et al.
2015/0330217 A1 11/2015 Liu et al.
2015/0377014 A1 12/2015 Lee et al.
2015/0377015 A1 12/2015 Lee et al.
2015/0377018 A1 12/2015 Lee et al.
2016/0245079 A1 8/2016 Perry et al.
2016/0258274 A1 9/2016 Bittar et al.
2016/0258277 A1 9/2016 Bittar et al.
2017/0138186 A1 5/2017 Lee et al.
2017/0198570 A1 7/2017 Lee et al.
2017/0248010 A1 8/2017 Lee et al.
2017/0260853 A1 9/2017 Stack et al.
2018/0171785 A1 6/2018 Lee et al.
2018/0230800 A1 8/2018 Turner
2019/0017372 A1 1/2019 Lee et al.

FOREIGN PATENT DOCUMENTS

EP 0325047 A2 7/1989
EP 0333484 A2 9/1989
EP 0535815 A1 4/1993
EP 0916807 A2 5/1999
EP 0747571 B1 2/2000
EP 2957717 A1 * 12/2015 ..... E21B 47/182
GB 2156405 A 10/1985
WO 9744565 A1 11/1997
WO 0229441 A1 4/2002
WO 2016138391 A1 9/2016

OTHER PUBLICATIONS

Drumheller, Douglas S.; "Coring in Deep Hardrock Formations"; Sandia National Laboratories for the United States Department of Energy; Aug. 1988; 53 Pages.
Montaron, et al., SPE 25356, "Improvements in MWD Telemetry: "The Right Data at the ight Time"", 1993 (10 pgs.).
Unknown, Stratamagnetic Software, LLC, "Measurement While Drilling" http://www.stratamagnetic.com/features-mwd.htm downloaded Nov. 22, 2019 (11 pgs).
International Search Report and Written Opinion; PCT/US2021/035405; Korean Intellectual Property Office; dated Sep. 9, 2021; 8 pages.

* cited by examiner

ANGLE-DEPENDING VALVE RELEASE UNIT FOR SHEAR VALVE PULSER

CROSS-REFERENCE TO RELATED APPLICATIONS

This application claims the benefit of an earlier filing date from U.S. Provisional Application Ser. No. 63/033,532, filed Jun. 2, 2020, the entire disclosure of which is incorporated herein by reference.

BACKGROUND

Field of the Invention

The present disclosure relates to drilling fluid telemetry systems and, more particularly, to telemetry systems that incorporate an oscillating shear valve for modulating a pressure of a drilling fluid that circulates in a tubular string within a well bore.

Description of the Related Art

Drilling fluid telemetry systems, generally referred to as mud pulse systems, are particularly adapted for telemetry (transmission) of information from the bottom of a borehole to the surface of the earth during subsurface operations (e.g., oil well drilling). The information telemetered often includes, but is not limited to, parameters of pressure, temperature, direction, and deviation of the well bore. Other parameters include logging data such as resistivity of various formation layers, sonic, density, porosity, induction, self-potential, and pressure gradients. Such information may be critical to efficiency in the drilling operation.

The telemetry operation employs the use of a mud pulse valve to generate pressure pulses within a fluid (i.e., drilling mud). Mud pulse valves must operate under extremely high static downhole pressures, high temperatures, high flow rates, and various erosive flow and fluid types. At these conditions, the mud pulse valve must be able to create pressure pulses of around 100-300 psi.

Different types of valve systems can be used to generate downhole pressure pulses to perform telemetry. Valves that open and close a bypass from the inside of the tubular string to the wellbore annulus create negative pressure pulses, for example see U.S. Pat. No. 4,953,595. Valves that use a controlled restriction placed in the circulating mud stream are commonly referred to as positive pulse systems, for example see U.S. Pat. No. 3,958,217. The contents of these patents are incorporated herein in their entireties.

It is desirable to increase mud pulse data transmission rates to accommodate large amounts of measured downhole data that is required to be transmitted to the surface. One major disadvantage of available mud pulse valves is a low data transmission rate. Increasing the data rate with available valve types leads to unacceptably large power consumption, unacceptable pulse distortion, or may be physically impractical due to erosion, washing, and abrasive wear. Because of low activation/operational speed, nearly all existing mud pulse valves are only capable of generating discrete pulses. To effectively use carrier waves to send frequency shift (FSK) or phase shift (PSK) coded signals to the surface, the actuation speed must be increased and fully controlled.

An example for a negative pulsing valve is illustrated in U.S. Pat. No. 4,351,037. The content of this document is incorporated herein in its entirety. This technology includes a downhole valve for venting a portion of the circulating fluid from the interior of the tubular string to the annular space between the pipe string and the borehole wall. Drilling fluids are circulated down the inside of the tubular string, out through the drill bit and up the annular space to surface. By momentarily venting a portion of the fluid flow out a lateral port, an instantaneous pressure drop is produced and is detectable at the surface to provide an indication of the downhole venting. A downhole instrument is arranged to generate a signal or mechanical action upon the occurrence of a downhole detected event to produce the above described venting. The downhole valve disclosed is defined in part by a valve seat having an inlet and outlet and a valve stem movable to and away from the inlet end of the valve seat in a linear path with the tubular string.

As will be appreciated by those of skill in the art, all negative pulsing valves need a certain high differential pressure below the valve (i.e., downhole) to create sufficient pressure drop when the valve is open. Because of this high differential pressure, negative pulse valves are typically prone to washing. In general, it is not desirable to bypass flow above the bit into the annulus. Therefore, it must be ensured that the valve is able to completely close the bypass. With each actuation, the valve hits against the valve seat. Because of this impact, negative pulsing valves are more prone to mechanical and abrasive wear than positive pulsing valves.

In contrast to negative pulsing valves, positive pulsing valves might, but do not need to, fully close the flow path for operation. Positive poppet-type valves are less prone to wear out the valve seat. The main forces acting on positive poppet-type valves are hydraulic forces, because the valves open or close axially against the flow stream. To reduce the actuation power some positive poppet-type valves are hydraulically powered as described in U.S. Pat. No. 3,958,217. The content of this document is incorporated herein in its entirety. In such configurations, the main valve is indirectly operated by a pilot valve. The low power consumption pilot valve closes a flow restriction, which activates the main valve to create the pressure drop. The power consumption of this kind of valve is very small. The disadvantage of this valve is the passive operated main valve. With high actuation rates, the passive main valve is not able to follow the active operated pilot valve. As such, a pulse signal generated downhole will become highly distorted and hardly detectable at the surface.

An alternative configuration includes rotating disc valves configured to open and close flow channels perpendicular to the flow stream. Hydraulic forces acting against such valves are smaller than for poppet-type valves. However, with increasing actuation speed, dynamic forces of inertia are the main power consuming forces. For example, U.S. Pat. No. 3,764,968 describes a rotating valve configured to transmit frequency shift key (FSK) or phase shift key (PSK) coded signals. The content of this document is incorporated herein in its entirety. The valve uses a rotating disc and a non-rotating stator with a number of corresponding slots. The rotor is continuously driven by an electric motor. Depending on the motor speed, a certain frequency of pressure pulses are created in the flow as the rotor intermittently interrupts the fluid flow. Motor speed changes are required to change the pressure pulse frequency to allow FSK or PSK type signals. There are several pulses per rotor revolution, corresponding to the number of slots in the rotor and stator. To change the phase or frequency, the rotor is required to increase or decrease in speed. This may take a rotor revolution to overcome the rotational inertia and to achieve the new phase or frequency, thereby requiring several pulse cycles to make the transition. Amplitude coding of the signal is inherently not possible with this kind of continuously rotating device. In order to change the frequency or phase, large moments of inertia, associated with the motor, must be overcome, requiring a substantial amount of power. When continuously rotated at a certain speed, a turbine might be used or a gear might be included to reduce power consumption of the system. On the other hand, both options dramatically increase the inertia and power consumption of the system when changing from one speed to another speed for signal coding.

The aforesaid examples illustrate some of the critical considerations that exist in the application of a fast acting valve for generating a pressure pulse. Other considerations in the use of these systems for borehole operations involve the extreme impact forces, such as dynamic (vibrational) energies, existing in a moving tubular string. The result is excessive wear, fatigue, and failure in operating parts of the system. The particular difficulties encountered in a tubular string environment, including the requirement for a long lasting system to prevent premature malfunction and replacement of parts, require a robust and reliable valve system.

SUMMARY

Systems and methods for generating pulses in a drilling fluid are provided herein. In accordance with some embodiments, the pulser assemblies are configured to be positioned along a tubular string through which a drilling fluid flows. The pulser assemblies include a housing configured to be supported along the tubular string, a valve stator supported by the housing, the valve stator having at least one flow path that extends from an upstream end to a downstream end of the valve stator, a valve rotor positioned adjacent the valve stator, the valve rotor configured to selectively obstruct the at least one flow path, wherein an axial gap is present between the valve rotor and the valve stator, a motor operably coupled to the valve rotor, wherein the motor is operable to rotate the valve rotor relative to the valve stator, and an axial release assembly including a rotational element configured to adjust the axial gap between the valve rotor and the valve stator based on a rotation of the rotational element.

In accordance with some embodiments, methods for generating pulses in a drilling fluid are provided. The methods include driving rotation of a valve rotor relative to a valve stator of a pulser assembly, wherein the pulser assembly comprises a housing with a motor arranged within the housing and configured to drive rotational movement of the valve rotor; and adjusting an axial gap between the valve rotor and the valve stator using an axial release assembly, including a rotational element, based on a rotation of the rotational element.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative, explanatory in nature, and non-limiting.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

A detailed description of one or more embodiments of the disclosed apparatuses and methods presented herein are presented by way of exemplification and not limitation, with reference made to the appended figures.

Figure 1:
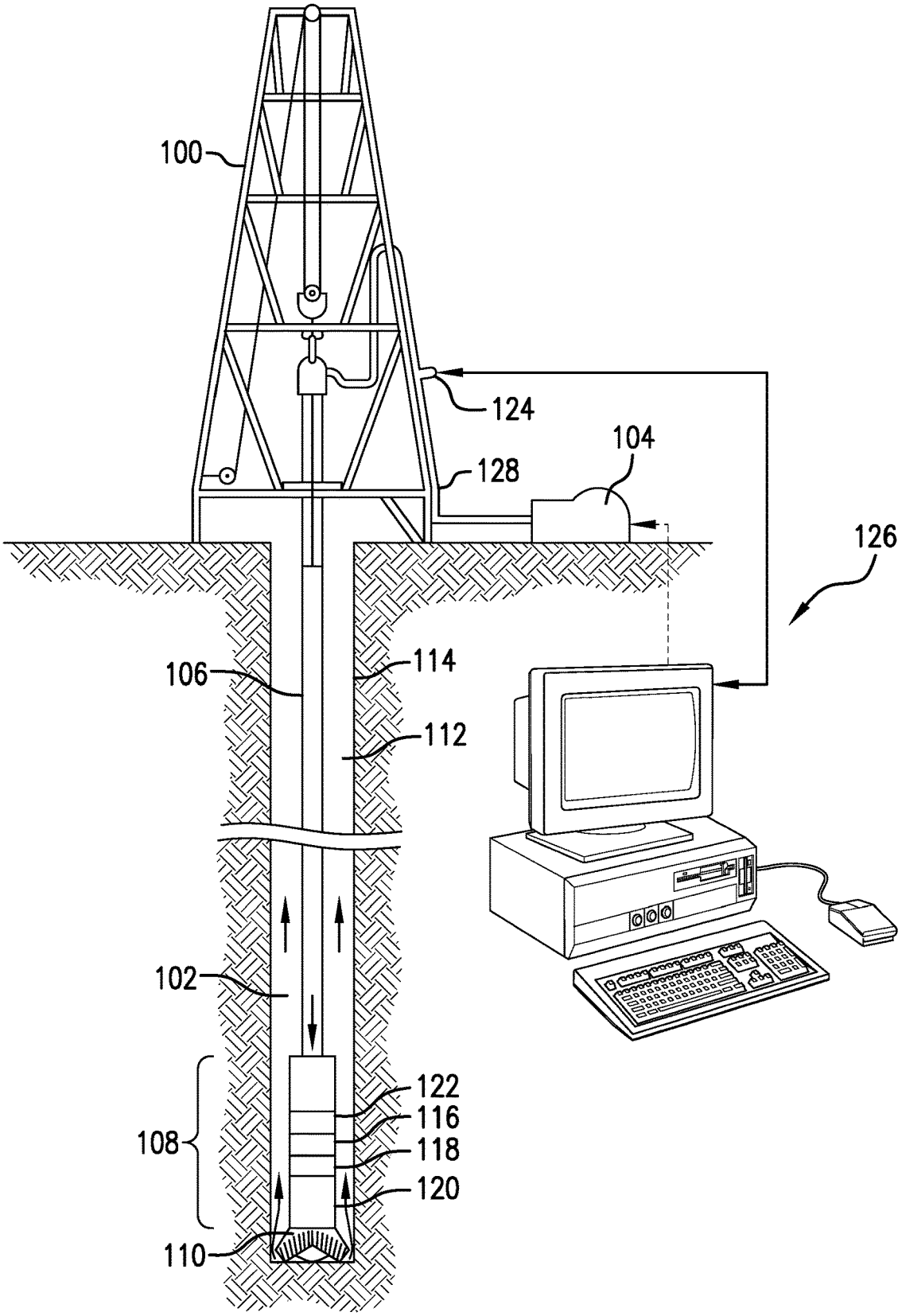
FIG. 1 is a schematic diagram showing a drilling rig engaged in drilling operations that can incorporate embodiments of the present disclosure.

FIG. 1 is a schematic diagram showing a drilling rig 100 engaged in drilling operations. A drilling fluid 102, also called drilling mud, is circulated by a pump 104 through a tubular string 106 down through a bottom hole assembly (BHA) 108, through a drill bit 110 and back to the surface through an annulus 112 between the tubular string 106 and a borehole wall 114. The BHA 108 can include any of a number of sensor modules 116, 118, 120. The sensor modules 116, 118, 120 can include formation evaluation sensors, directional sensors, probes, pressure sensors, power generators (e.g., including a turbine), etc. as will be appreciated by those of skill in the art. Such sensors and modules are well known in the art and are not described further. The BHA 108 also contains a pulser assembly 122. The pulser assembly 122 is configured to induce pressure fluctuations in a mud-flow of the drilling fluid 102. The pressure fluctuations, or pulses, propagate to the surface through the drilling fluid 102 in the tubular string 106 and/or through the drilling fluid 108 in the annulus 112 and are detected at the surface by a pulse sensor 124 and an associated a control unit 126. The control unit 126 may be a general purpose or specialized computer or other processing unit, as will be appreciated by those of skill in the art. The pulse sensor 124 is connected to a flow line 128 and may be a pressure transducer (pressure sensor) or flow transducer, as will be appreciated by those of skill in the art.

Figure 2A:
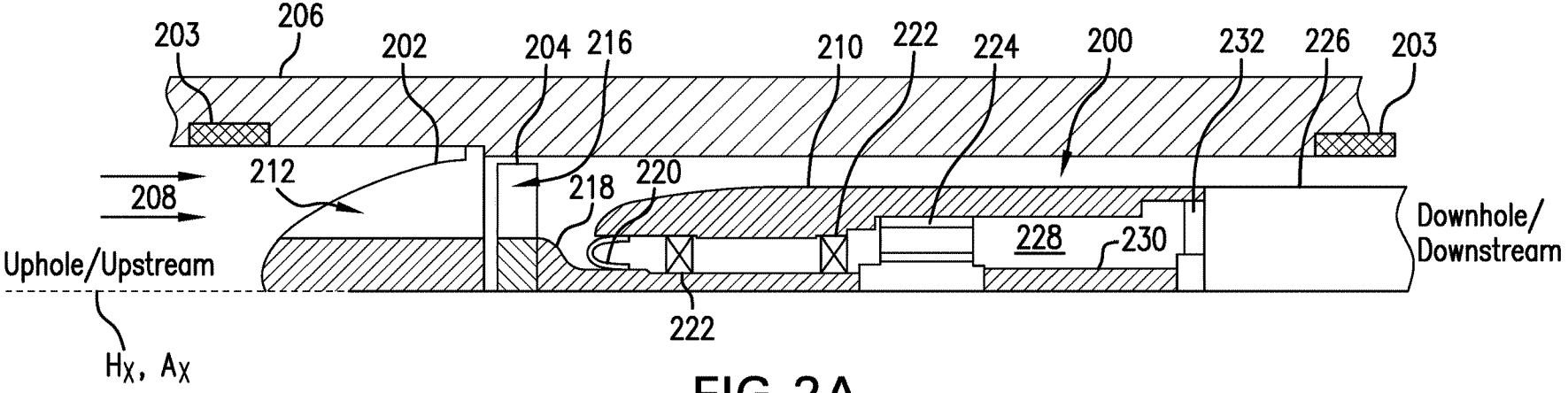
FIG. 2A is a schematic of a pulser assembly that may incorporate embodiments of the present disclosure.
Figure 2B:
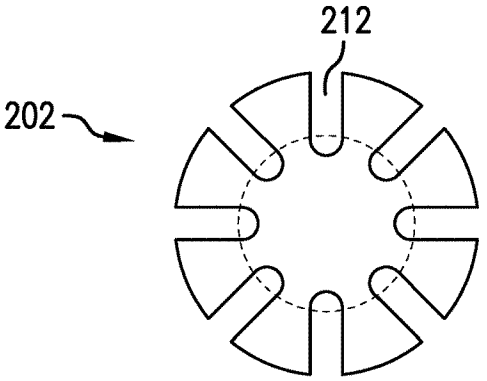
FIG. 2B is a schematic illustration of a stator of the pulser assembly of FIG. 2A.
Figure 2C:
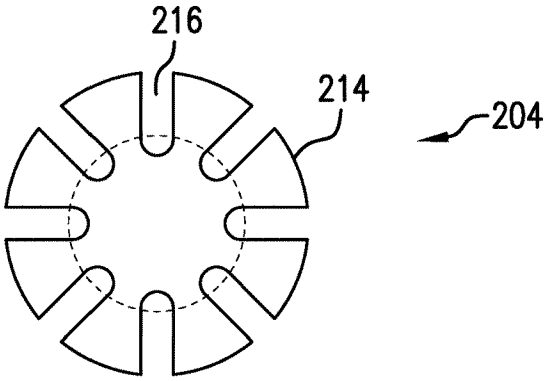
FIG. 2C is a schematic illustration of a rotor of the pulser assembly of FIG. 2A.

Turning now to FIGS. 2A-2C, schematic illustrations of a pulser assembly 200 are shown. FIG. 2A is a partial cross-sectional schematic of the pulser assembly 200, FIG. 2B is a schematic of a stator 202 of the pulser assembly 200, and FIG. 2C is a schematic of a rotor 204 of the pulser assembly 200. The pulser assembly 200 may be installed or otherwise employed in downhole systems, such as shown and described with respect to FIG. 1. In this embodiment, the pulser assembly 200 is arranged as an oscillating shear valve assembly that is configured for mud pulse telemetry. The pulser assembly 200, as shown, is arranged in an inner bore of a tool housing 206. In some embodiments, the tool housing 206 may be a bored drill collar in a bottom hole assembly (e.g., as shown in FIG. 1). The tool housing 206 may define an outer surface of a downhole tool and may be exposed to an annulus between the downhole tool 206 and a borehole wall or a borehole casing. In other embodiments, the tool housing 206 may be a separate housing adapted to fit into a drill collar bore. Various other configurations are possible without departing from the scope of the present disclosure. In operation, e.g., while drilling, a drilling fluid 208 will flow through the stator 202 and the rotor 204 and passes through the annulus between a pulser housing 210 and the inner diameter or surface of the tool housing 206. In accordance with some embodiments of the present disclosure, and without limitation, the shear valve pulser may be configured to achieve a data rate between 1 Hz and 60 Hz.

The stator 202, shown in FIGS. 2A and 2B, is fixed with respect to the tool housing 206 and to the pulser housing 210. The stator 202 may define or include one or more lengthwise stator passages 212 (state flow passages). The rotor 204, shown in FIGS. 2A and 2C, is disk shaped with one or more notched blades 214 defining one or more rotor passages 216 (rotor flow passages) similar in size and shape to the one or more stator passages 212 in the stator 202 (although with less axially length, as shown in FIG. 2A). Although shown as flow passages (defined by blades), in some embodiments holes or apertures may be formed in the stator and the rotor, respectively. The rotor passages 216 are configured such that the rotor passages 216 will be aligned, at certain angular positions, with the stator passages 212 to define straight or substantially straight (i.e., axial) flow paths. The rotor 204 is positioned in close proximity to the stator 202 and is configured to rotationally oscillate or be rotationally driven. The rotor 204 and the stator 202 are separated in an axial direction by a gap, also referred to as a valve gap or axial gap. In some non-limiting embodiments, the valve gap may be in the range of a few millimeters (e.g., 0.5 mm to 2 mm). An angular displacement of the rotor 204 relative to the stator 202 will change the effective flow area of the axial flow paths defined by the flow passages 212, 216, and thus create pressure fluctuations in a circulated mud column in the borehole. The tool housing includes a longitudinal axis $H_x$, which coincides with the rotational symmetry axis of the tool housing. A longitudinal axis $A_x$ of the pulser assembly 200 and/or the pulser housing 210 coincides with the rotational symmetry axis of the pulser assembly 200 and/or pulser housing 210, respectively. In some embodiments, the axes $H_x$, $A_x$ may coincide, although in other embodiments such alignment may not be present. In some embodiment, the pulser assembly 200 and/or the pulser housing 210 may be located off-center with respect to the tool housing, and thus the axes $H_x$, $A_x$ may not align or coincide.

To achieve one pressure cycle, it is necessary to open and close the axial flow path(s) by changing the angular positioning of the rotor blade(s) 214 with respect to the stator passage(s) 212. This can be done with an oscillating movement of the rotor 204. The rotor blades 214 are rotated in a first direction until the flow area is fully or partly restricted. Such partial or full restriction (or blocking) will create or generate a pressure increase in the fluid. The rotor blades 214 are then rotated in the opposite direction to open the flow path again. As the flow paths are opened, the pressure will decrease. The required angular displacement to generate a pressure pulse depends on the design of the rotor 202 and the stator 204. The larger the obstruction of the flow path, the larger is the resulting pressure fluctuation (pressure pulse). The narrower the flow paths of the pulser assembly 200 are designed, the more the amount of angular displacement required to create a pressure fluctuation is reduced. It is typically desirable for the amount of angular displacement to be relatively small (and thus relatively narrow flow openings may be more desirable). However, narrow flow openings may have the disadvantage of being blocked by debris or foreign particles in a fluid stream, and thus a compromise between narrow openings for low displacement and larger openings for allowing debris to pass therethrough must be made.

The power required to accelerate the rotor 204 is proportional to the angular displacement. The lower the angular displacement is, the lower the required actuation power to accelerate or decelerate the rotor 204. As an example, with eight flow openings (rotor passages 216) on the rotor 204 and on the stator 202 (stator passages 212) and maximizing the cross section of the flow opening, an angular displacement of the rotor 204 of approximately 22.5° is used to create a pressure drop. Having such relatively low angular displacement angle may ensure a relatively low actuation energy, even at high pulse frequencies. In some configurations, it may not be necessary to completely block the flow of fluid through the flow paths to create a pressure pulse. As such, different amounts of blockage, or angular rotation, can be used to create different pulse amplitudes.

The rotor 204, as shown in FIG. 2A, is attached or operably coupled to a drive shaft 218. As such, the rotation of the drive shaft 218 can cause rotation or oscillation of the rotor 204. The drive shaft 218 passes through a seal 220 and fits through one or more bearings 222. The bearings 222 are configured to fix the drive shaft 218 in radial and axial position with respect to the pulser housing 210. The drive shaft 218 is operably connected to a motor 224 (pulse motor), with the drive shaft 218 configured to be rotationally or oscillatory driven by the motor 224. The drive shaft 218 may be substantially parallel to the axis $A_x$ of the pulser assembly 200. The motor 224 may be, for example, an electric motor, such as a reversible brushless DC motor, a servomotor, or a stepper motor. The motor 224 can be configured to be electronically controlled, such as by circuitry in an electronics module 226. The electronics module 226 can enable precise operation of the rotor 204, such as in an oscillatory movement in both rotational directions (e.g., clockwise or positive rotational direction and counterclockwise or negative rotational direction). The precise control of the rotor 204 position provides for specific shaping of a pressure pulse generated by a fluid flow (e.g., drilling mud) through the pulser assembly 200. The electronics module 226 may contain a programmable processor that can be preprogrammed to transmit data utilizing any of a number of encoding schemes, which include, but are not limited to, Amplitude Shift Keying (ASK), Frequency Shift Keying (FSK), or Phase Shift Keying (PSK) or the combination of these techniques. A downhole power generator (not shown) may provide the power to the motor 224 and the electronics module 226. The power generator may generate power from the flow energy provided by the circulated drilling mud using a turbine wheel. In some embodiments, the power to drive the motor may be provided by a downhole battery, for example.

In some embodiments, the tool housing 206 can include one or more pressure sensors 203 mounted in locations above (uphole/upstream) and below (downhole/downstream) the pulser assembly 200. Such pressure sensors may be configured with a sensing surface exposed to the fluid flowing through the tubular string bore (drilling mud 208). The pressure sensors can be powered by the electronics module 226 and may be configured to receive surface transmitted pressure pulses. The processor and/or circuitry in the electronics module 226 may be programmed to alter data encoding parameters based on received surface transmitted pulses. The encoding parameters can include type of encoding scheme, baseline pulse amplitude, baseline frequency, or other parameters affecting the encoding of data. In some embodiments, the pressure sensors 203 may be used to monitor pressure fluctuations generated by the oscillating rotor 204. Depending on the monitored pressure fluctuation over time, encoding parameters may be adapted.

The pulser housing 210 may be filled with an appropriate lubricant 228 to lubricate the bearings 222 and to pressure compensate the interior of pulser housing 210 with a downhole pressure of the drilling mud 208. The bearings 222 are typical anti-friction bearings known in the art and are not described further. In some embodiment, and as shown, the seal 220 may be configured as a flexible bellows seal that directly couples to the drive shaft 218 and to the pulser housing 210. As such, the seal 220 may seal (e.g., hermetically) the lubricant 228 (e.g., oil) filled pulser housing 210. The angular movement or rotation of the drive shaft 218, as driven by the motor 224, causes a flexible material of the seal 220 to twist, thereby accommodating the angular motion while maintaining the sealing of the lubricant 228 within the pulser housing 210. In some embodiments, flexible bellows material of the seal 220 may be an elastomeric material, a fiber-reinforced elastomeric material, or other suitable material as will be appreciated by those of skill in the art. Depending on the material of the seal 220, the arrangement of components, etc., it may be necessary to keep the angular rotation of the drive shaft 218 relatively small so that the material of the seal 220 will not be overstressed by the twisting motion. In other configurations, the seal 220 may be an elastomeric rotating shaft seal or a mechanical face seal, as will be appreciated by those of skill in the art. That is, the seal 220 may take various configurations and arrangements that provides for a sealed, lubricant-filled internal structure of the pulser assembly 200, without departing from the scope of the present disclosure.

In some embodiments, the motor 224 may be configured with a double-ended shaft or a hollow shaft. In some such embodiments, one end of the motor shaft is attached to the drive shaft 218 of the pulser assembly 200 and the other end of the motor shaft is attached to a torsion spring 230. The torsion spring 230 may be anchored to an end cap 232. In such embodiments, the torsion spring 230, the drive shaft 218, and the rotor 216 are configured as a mechanical spring-mass system. The torsion spring 230 is designed such that the spring-mass system is at its natural frequency at, or near, a desired oscillating pulse frequency of the pulser assembly 200. The methodology for designing a resonant torsion spring-mass system is well known in the mechanical arts and is not described here. The advantage of a resonant system is that once the system is at resonance, the motor 224 only has to provide power to overcome external forces and system dampening, while the rotational inertia forces are balanced out by the resonating system. As described in FIG. 2, the stator 202 and the rotor 204 may be located on the uphold side (e.g., closer to the earth surface) of the pulser assembly 200. The stator 202 may be arranged uphole of the rotor 204. Drilling mud circulated downhole by a surface mud pump passes first the stator 202 and then the rotor 204. In an alternative configuration, the stator 202 and the rotor 204 may be arranged downhole of the pulser motor 224. In some such embodiments, the stator 202 may be arranged downhole of the rotor 204. The drilling mud thus passes the rotor 204 before it passes the stator 202. In both configurations, the pulser motor uphole or downhole, the stator/rotor (uphole/downhole relative to the valve), the stator can alternatively be located between the rotor and the pulser motor. In some such configurations, the drive shaft, connecting the rotor and the pulser motor, may run through the valve stator.

Figure 3A:
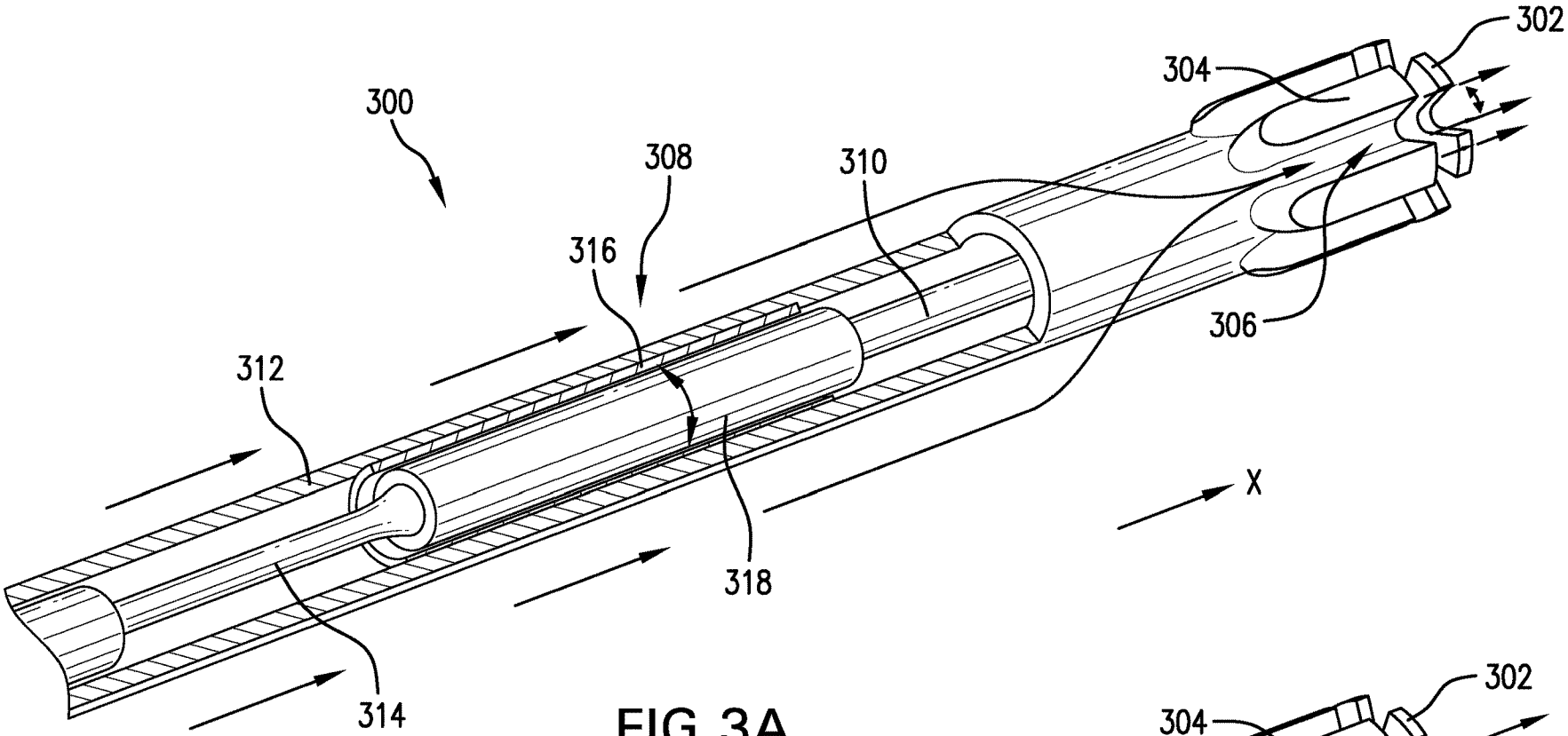
FIG. 3A is a schematic of a pulser assembly that may incorporate embodiments of the present disclosure.
Figure 3B:
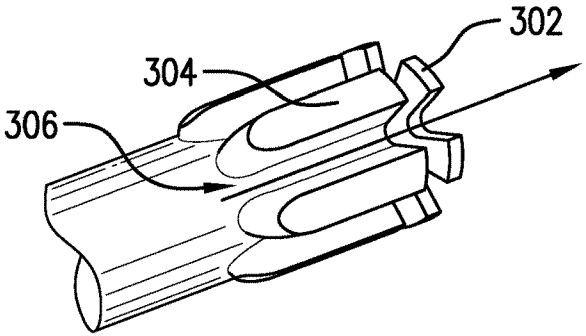
FIG. 3B is a schematic illustration of a portion of the pulser assembly of FIG. 3A illustrating an open flow path of the pulser assembly.

Turning now to FIGS. 3A-3B, schematic illustrations of a pulser assembly 300 are shown. FIG. 3A illustrates the pulser assembly 300 in a closing state and FIG. 3B illustrates the pulser assembly 300 in an open state. The pulser assembly 300 includes a valve rotor 302 that is moveable (rotationally) relative to a valve stator 304. The valve rotor 302 may be configured to selectively obstruct one or more flow passages 306 of the valve stator 304. In FIGS. 3A-3B, a flow direction X is to the right (downhole side) on the page, such that the valve stator 304 is arranged upstream from the valve rotor 302. The valve rotor 302 may be driven in an oscillatory fashion (as compared to full circles) by a motor 308. The motor 308 may be an electronic motor that drives a drive shaft 310 that is operably coupled to the valve rotor 302 and enables and drives oscillatory motion of the valve rotor 302. The motor 308 and the drive shaft 308 are contained within a pulser housing 312 that protects such components (and other components) from a drilling fluid passing along and through the pulser assembly 300, as described above. Operably coupled to the drive shaft 310 may be a torsional spring 314, which may be housed within the pulser housing 312.

As the motor 308 drives the drive shaft 310 and thus the valve rotor 302, one or more obstructing elements of the valve rotor 302 (e.g., blades) may be oscillated into an obstructing position to restrict or otherwise block a flow through the flow passages 306 of the valve stator 304. When the obstructing elements of the valve rotor 302 are aligned with portions of the valve stator 304, the flow passages 306 of the valve stator 304 may be fully opened, as shown in FIG. 3B. The obstructing of the flow through the flow passages 306 of the valve stator 304 will cause or generate pressure pulses within the fluid passing through the pulser assembly 300. In the open state (FIG. 3B) a drilling mud can pass through the pulser assembly 300 and through the flow passages 306 thereof. The flow of fluid may be precluded when the valve rotor 302 (i.e., obstructing elements thereof) are moved to block the flow passages 306. The valve rotor 302, as noted above, is connected to the drive shaft 310, which is radially and axially mounted within the pulser housing 312. The drive shaft 310 is oscillated by a drive system (motor 308 and associated electronics) which converts an electrical coded signal into mud pulse signal that is used to drive a torque and thus oscillate the valve rotor 302.

The motor 308 may be an electric motor having a motor stator 316 and a motor rotor 318. The motor rotor 318 may be operably connected to the drive shaft 310 to drive rotational movement (e.g., oscillation) of the drive shaft 310. The motor stator 316 may be controlled to generate electrical pulses that drive oscillation of the motor rotor 318, and as the motor rotor 318 is oscillated, a torque will be applied to the drive shaft 310. The motor stator 316 may be fixedly mounted within the pulser housing 312. In this illustrative embodiment, the drive shaft 310, as noted above, is connected to a rotational effective spring element (i.e., the torsional spring 314). The torsional spring 314 is configured to reset the orientation of the drive shaft 310 to a defined zero-position to guarantee a defined position between the valve rotor 302 and the valve stator 304 of the pulser assembly 300, usually a valve open position.

In operation, a flow of drilling mud may contain particulate (e.g., Lost Circulation Material (LCM)) that may be caught between the structure of the valve rotor and the valve stator (e.g., in an axial gap between the valve rotor and the valve stator). Typically, the gap (valve gap) between the valve rotor and the valve stator is a fixed separation distance, and if a particle size is too large, such particle may become stuck or plug the gap between the valve rotor and the valve stator. To avoid this, the gap or separation distance between the valve rotor and the valve stator may be configured to be larger. However, such larger axial gap can cause the pressure differential across the valve rotor to be less and thus reduce the efficiency of pressure pulse generation by the pulser assembly (e.g., reduced signal quality and/or amplitude in the generated pulses). Thus, a balance between maintaining a narrow gap for quality pulse generation and a large gap to prevent valve plugging must be made. A typical gap between the valve rotor and the valve stator may be in the range of a few millimeters, such as, for example, and without limitation, 1 mm to 2 mm (e.g., 1.5 mm).

In view of this, embodiments of the present disclosure are directed to a controlled axial gap that varies the gap based on angular displacement angle of the valve rotor and, in some embodiments, on torque acting on the valve rotor. As such, in accordance with some embodiments, a valve rotor may be axially moveable to increase or decrease a gap between the valve rotor and a valve stator based on an angular position or torque applied to the drive shaft that drives the motion of the valve rotor. Accordingly, in some embodiments of the present disclosure, an axial gap control is operably or functionally coupled to a torque and angular displacement angle of oscillation of the pulser assembly system.

Figure 4:
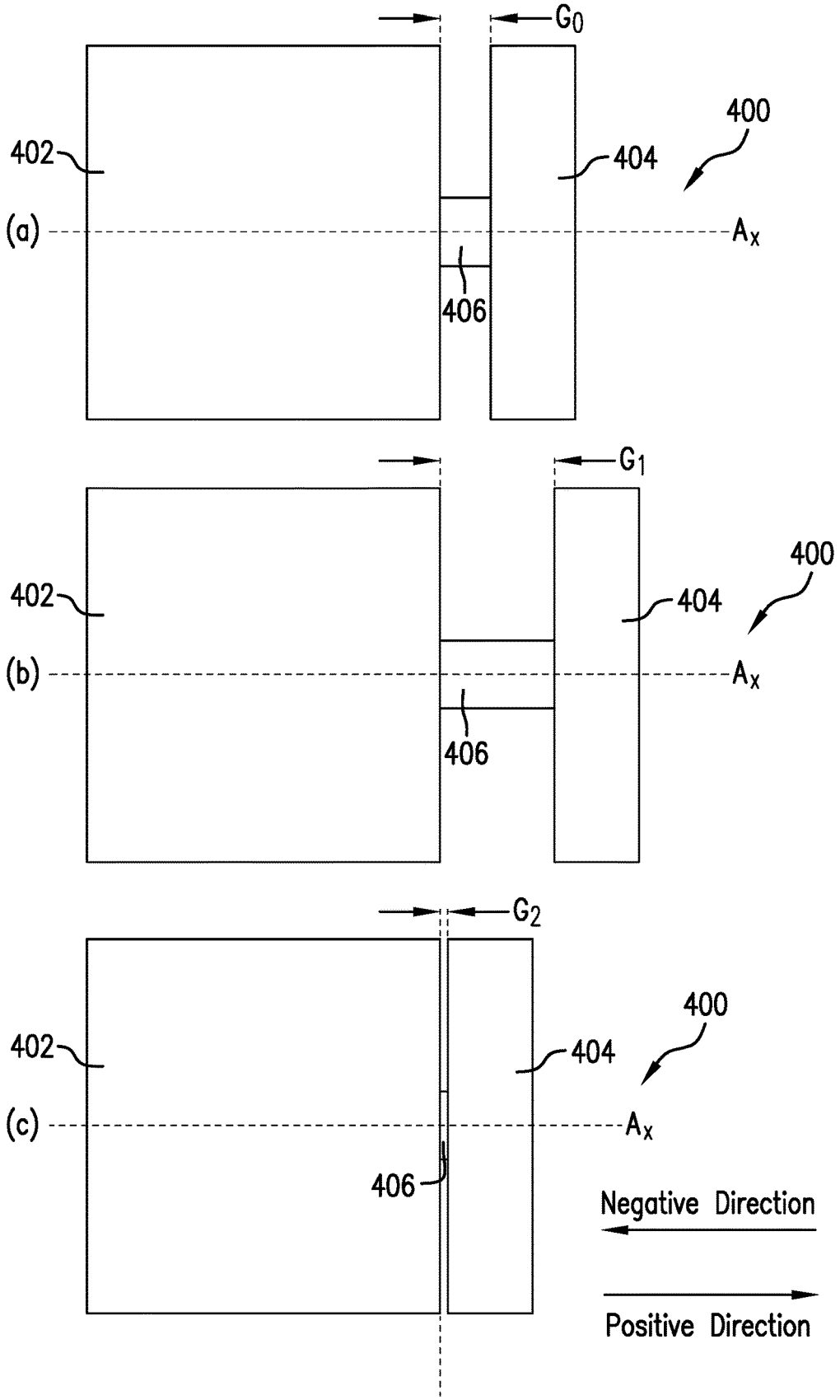
FIG. 4 is a sequence of orientations illustrating different valve gaps of a pulser assembly in accordance with an embodiment of the of the present disclosure.

FIG. 4 is a series of illustrations schematically showing example gaps of a pulser assembly installed on a downhole tool 400, in accordance with an embodiment of the present disclosure. The pulser assembly defines an axis $A_x$ that runs through the pulser housing or a pulser body and may be arranged in a flow direction of a fluid flowing through the downhole tool having the pulser assembly included therein. The axis $A_x$ is a longitudinal axis of the downhole tool 400. The pulser assembly includes a valve stator 402 and a valve rotor 404. The valve rotor 404 is connected to a drive shaft 406 that is configured to drive rotation and/or oscillations of the valve rotor 404 relative to the valve stator 402 to generate pressure pulses within a fluid passing through the downhole tool 400.

Orientation (a) of FIG. 4 may be illustrative of a default or initial spacing or separation between the valve stator 402 and the valve rotor 404, as indicated by initial gap $G_0$. The distance of the initial gap $G_0$ may be set for optimum pressure pulse generation. That is, the initial gap $G_0$ may be used during normal operation to generate clean and clear pressure pulses. However, if a foreign object (e.g., debris, particles, etc.) is lodged in the space between the valve stator 402 and the valve rotor 404, increasing the gap may enable dislodging and removal of any blockage. As such, embodiments of the present disclosure enable an axial translation of the valve rotor 404 relative to the valve stator 402 in a positive axial direction along the axis $A_x$, as shown in orientation (b) of FIG. 4 while the valve stator 402 remains axially stationary. In orientation (b) the spacing between the valve rotor 404 and the valve stator 402 has increased to an increased gap $G_1$, with the gap $G_1$ in this illustration being a fully extended position. In contrast, a negative axial direction along the axis $A_x$ may cause the spacing to decrease to the orientation shown in orientation (c) and a decreased gap $G_2$, with the gap $G_2$ in this illustration being a fully retracted position. The decreased gap $G_2$ can enable a high-pressure drop across the pulser assembly 400, such as when flow rates are low. However, at the decreased gap $G_2$ shown in orientation (c), the likelihood of debris plugging the gap increases. As such, embodiments of the present disclosure are directed to changing the gap between the valve stator and the valve rotor, to ensure strong or clear pulse signals while avoiding debris plugging the gap. In some embodiments, the valve stator 402 may axially be moved to increase or decrease the gap between the valve rotor 404 and the valve stator 402, while the valve rotor 404 remains axially stationary. Further, it will be appreciated that both components (e.g., valve rotor 404 and valve stator 402) may both be moved to adjust the gap between the components.

Figure 5A:
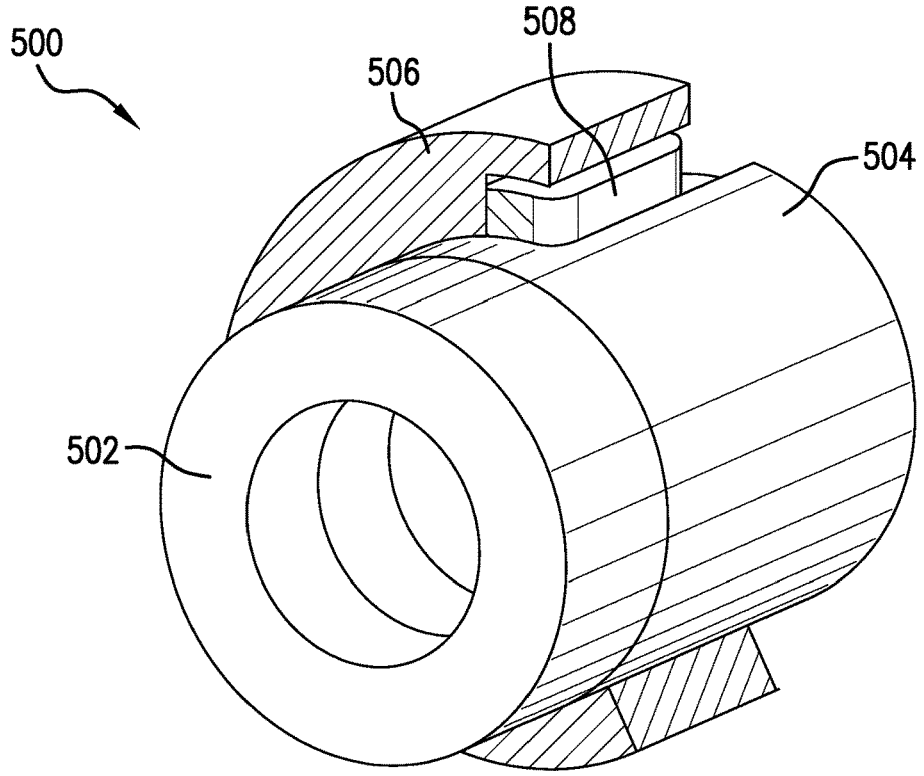
FIG. 5A is a schematic illustration of an axial release assembly in accordance with an embodiment of the present disclosure.
Figure 5B:
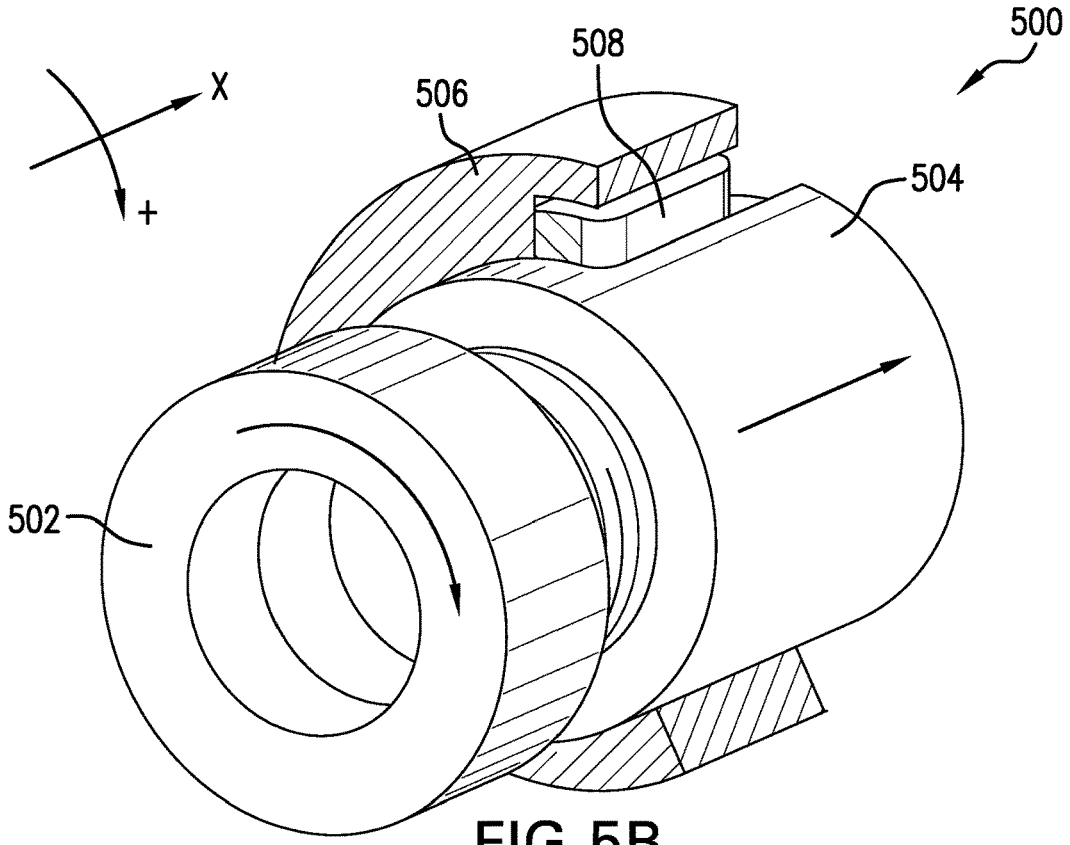
FIG. 5B illustrates a transition of the axial release assembly of FIG. 5A during operation.

Turning now to FIGS. 5A-5B, schematic illustrations of an axial release assembly 500 in accordance with an embodiment of the present disclosure are shown. FIG. 5A illustrates the axial release assembly 500 in a fully retracted state, which may be an initial position, and FIG. 5B illustrates the axial release assembly 500 in an extended state. The axial release assembly 500 includes a rotational element 502 and an axial movement element 504. The rotational element 502 may be operably connected to a motor rotor or a motor stator of a drive system of a pulser assembly and may be rotationally driven thereby. The axial movement element 504 is operably connected to the rotational element 502 and configured such that rotational movement of the rotational element 502 causes an axial movement of the axial movement element 504.

The axial movement element 504 is arranged within a pulser housing 506 of a pulser assembly. As used herein, axial movement is in a direction along a longitudinal axis of a downhole tool, such as the downhole tool housing or containing a pulser assembly, and rotational movement is movement about the longitudinal axis of the downhole tool. To ensure only axial movement of the axial movement element 504, the axial movement element 504, in this example embodiment, includes a key 508 (locking element) that may be arranged to slide or translate through a slot of the pulser housing 506. The key-slot configuration ensures that the axial movement element 504 does not rotate within the pulser housing 506 during rotation of the connected rotational element 502. Other mechanisms beside key-slot may be used, without departing from the scope of the present disclosure.

The axial movement element 504 is operably connected to a drive shaft of a pulser assembly. Axial movement of the axial movement element 504 is transferred to the drive shaft to displace the drive shaft axially. Because a valve rotor is connected to the drive shaft, as described above, as the drive shaft is translated axially, the valve rotor will translate axially, thus adjusting a gap between the valve rotor and a valve stator. In some embodiments, the axial movement element 504 may be connected to a bearing block of the drive shaft to allow the drive shaft to rotate relative to the axial movement element 504.

In accordance with one example operation of the axial release assembly 500, the axial release assembly 500 is configured to generate an axial movement of the valve rotor and a section of the drive shaft in the axial direction (indicated as direction x on FIGS. 5A-5B) as a function of the oscillation of the drive system or motor. While the valve rotor is oscillating, a gap between the valve stator and the valve rotor is varied by the axial release assembly 500. The axial release assembly 500 consists of the rotational element 502 that can oscillate or be driven by a torque transmitting element (i.e., driven by the motor stator, or attached to a motor rotor) of the drive system. When the rotational element 502 is rotated from the initial position (FIG. 5A) (angular displacement angle is zero) to a defined angular displacement position (FIG. 5B), the axial movement element 504 is axially moved in the x-direction (i.e., axial away from the rotational element 502) to a release position (e.g., fully extended position of the axial release assembly), as shown in FIG. 5B. The axial movement of the axial movement element 504 can be guided by one or more locking elements (e.g., key 508) which is located between the axial movement element 504 and the pulser housing 506. As such, the rotation of the rotational element 502 can be prevented from being transmitted to the axial movement element 504. When the rotational element 502 is reverted or returned back to the initial position (e.g., in an oscillatory manner), the axial movement element 504 is moved back to its initial position (shown in FIG. 5A), by an axial movement in the negative x-direction (i.e., axially toward the rotational element 502, fully retracted).

In some embodiments, the axial movement element may be axially and rotationally locked with the pulser housing and the rotational movement element may be rotationally and axially locked with the drive shaft. In such configurations, the rotational element may move axially and rotationally with respect to the pulser housing while no relative movement exists between the rotational element and the drive shaft. The axial movement created with rotating the rotational element with the drive shaft is transferred from the rotational element to the drive shaft. In some embodiments, the axial release assembly may not completely extend (e.g., partial extension). Any extension of the axial release assembly between a fully retracted state and a fully extended state is possible (i.e., partial extensions). The amount of extension depends upon the angular rotation angle of the rotational element. To fully retract the axial release element, an angular displacement angle of less than 360° is required. Typically, a rotation between 5° and 90° will extend the axial release assembly completely. More specifically, the angular displacement angle of the rotational element may be between 10° and 45°. In an alternative embodiment, the angular displacement angle may be between 15° and 35°. In yet another embodiment, the angular displacement angle of the rotational element may between 20° and 30°. In some embodiments, the axial displacement of the axial release assembly, when fully extended, may be 0.1 mm to 10 mm. In an alternative embodiment, the axial displacement (stroke or stroke length) of the axial release assembly, when fully extended, may be 0.1 mm to 2 mm. In yet another embodiment, the axial displacement of the axial release assembly, when fully extended, may be 0.4 mm to 1 mm.

Figure 6A:
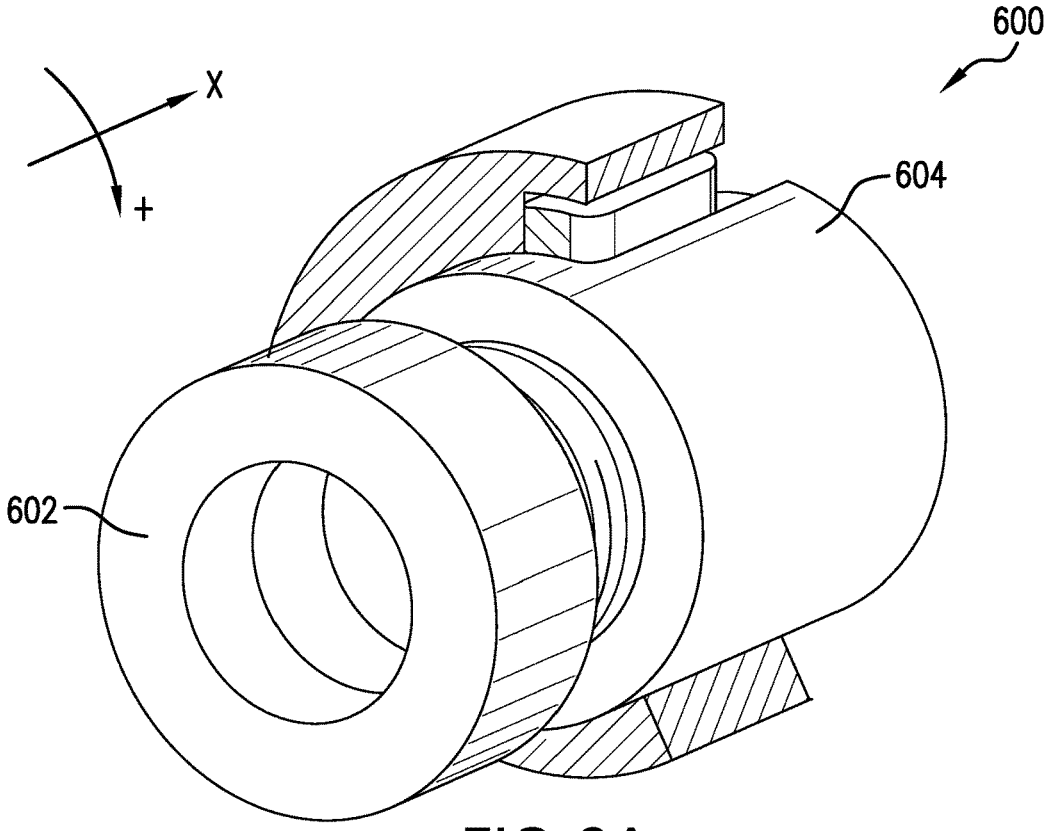
FIG. 6A is a schematic illustration of an axial release assembly in accordance with an embodiment of the present disclosure.
Figure 6B:
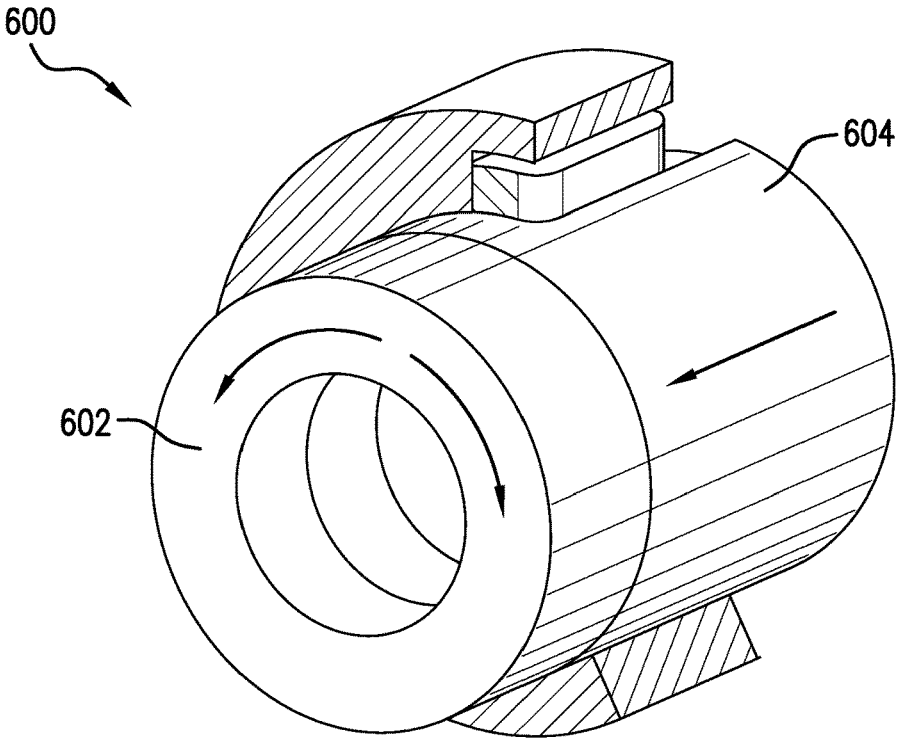
FIG. 6B illustrates a transition of the axial release assembly of FIG. 6A during operation.

Turning to FIGS. 6A-6B, an alternative configuration/operation of an axial release assembly 600, in accordance with an embodiment of the present disclosure, is shown. In this illustrative configuration, the axial release assembly 600 is designed such that the initial position is the axially extended state (FIG. 6A). As such, rotation of a rotational element 602 from the initial position (FIG. 6A) causes an axial movement of an axial movement element 604 to move toward the rotational element 602 (i.e., negative x-direction), as shown in FIG. 6B. The rotational direction may be positive rotational direction (e.g., clockwise) or negative rotational direction (e.g., counterclockwise). The rotational element may be connected to a rotating portion of a motor or other drive system of a pulser assembly and may be rotationally driven thereby. When the rotational element is returned to the normal or initial position, the axial movement element 604 is moved back in the positive x-direction, and thus would increase an axial gap. The extended state may be the fully extended or may be any state between the fully retracted state and the fully extended state. The amount of extension is determined by the angular displacement angle of the rotational element 602.

In the configuration of the axial release assembly 500 shown in FIGS. 5A-5B, the default or initial position is with the axial movement element 504 closest to the rotational element 502. As such, as the rotational element 502 is rotated, the axial movement element 504 is moved axially away from the rotational element 502. This means that the gap between a valve rotor and a valve stator increases as the rotational element 502 is rotated, and the gap decreases (or is smallest) when the rotational element 502 returns to the initial position. In contrast, in the axial release assembly 600 shown in FIGS. 6A-6B, the default or initial position is with the axial movement element 604 farthest from the rotational element 602. As such, as the rotational element 602 is rotated, the axial movement element 604 is moved axially toward the rotational element 602. This means that the gap between a valve rotor and a valve stator decreases as the rotational element 602 is rotated, and the gap increases (or is greatest) when the rotational element 602 returns to the initial position.

As such, it will be appreciated that the systems and assemblies described here can be configured with various directional orientations. That is the oscillation systems can be driven in both opposite directions, positive (+) or negative (−) rotation around the x-axis related to a positive or negative angular displacement angle of the rotational element. In accordance with some embodiments, the axial release assembly can be symmetrical, as illustrated in FIG. 6B, or asymmetrical. In symmetrical configurations, the axial movement element is configured to move in the same direction relative to the rotational element being rotated positive (+) or negative (−) from an initial position (zero degree angular displacement angle). In asymmetrical configurations, the axial movement element can move in different or opposite directions depending on if the rotational element is rotated positive (+) or negative (−) from an initial position. In the asymmetrical configurations, the initial or default position (default gap) may be a mid-distance gap or half extended state, with the positive rotation increasing a gap distance from the default gap and a negative rotation decreasing the gap distance from the default gap (e.g., FIG. 4). In an alternative embodiment, the initial position may be a fully extended state and a negative (−) or positive (+) rotation leads to the gap to decrease toward the fully retracted state. Further, in some embodiments, the initial position may be a fully retracted state and a positive (+) rotation or a negative (−) rotation leads to the gap increasing toward the fully extended state.

The coupling of rotational (oscillation) and axial movement, in accordance with various embodiments of the present disclosure, may be achieved using different mechanisms. That is, any rotational-to-axial movement conversion may be employed without departing from the scope of the present disclosure. The primary feature of such systems is coupling angular position/orientation and/or torque to an axial movement of the axial movement element (and thus axial movement of a valve rotor and controlling a gap of the pulser assembly).

Figure 7:
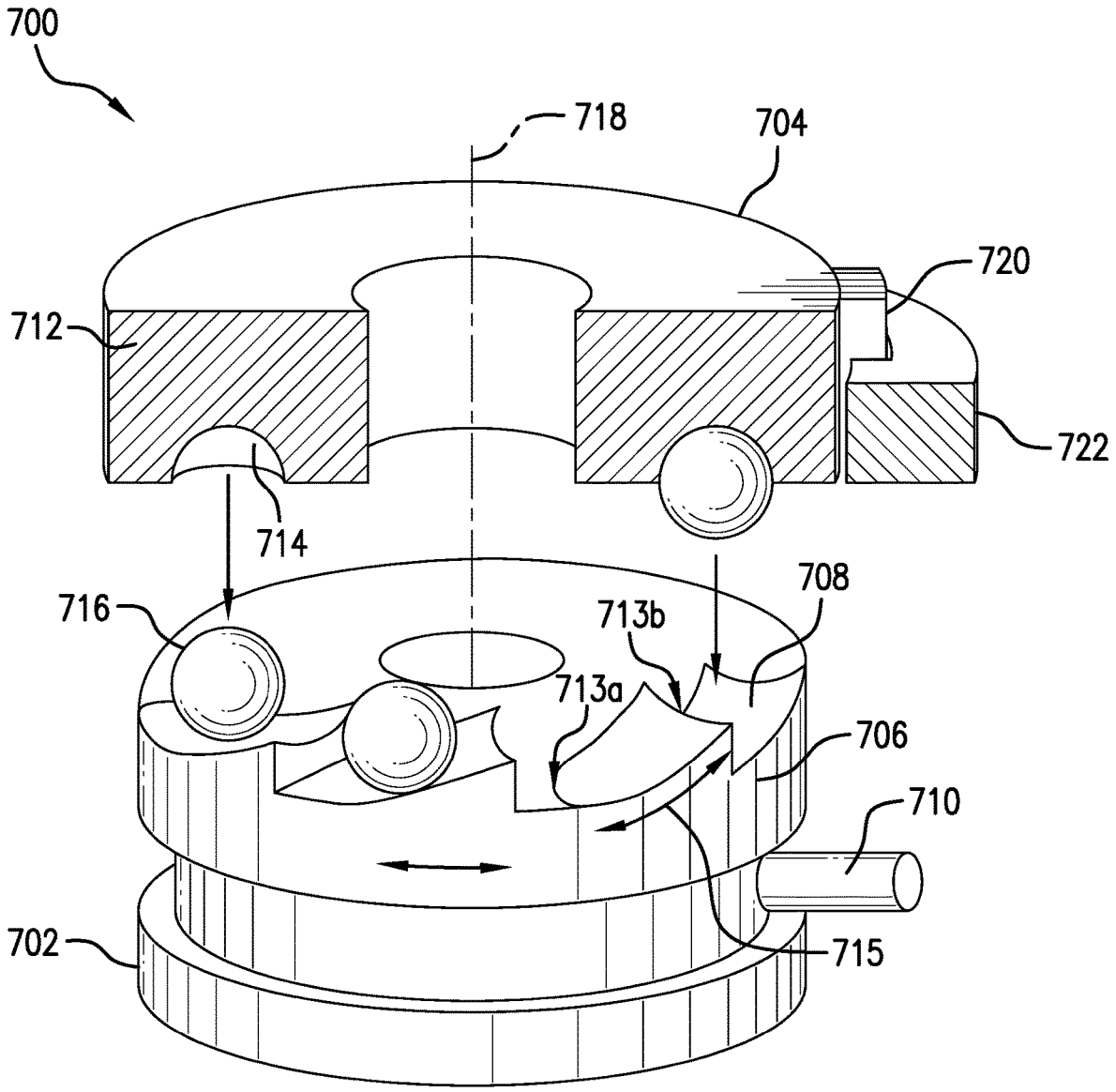
FIG. 7 is a schematic illustration of an axial release assembly in accordance with an embodiment of the present disclosure.

Turning now to FIG. 7, a schematic illustration of an axial release assembly 700 in accordance with an embodiment of the present disclosure is shown. The axial release assembly 700 includes a rotational element 702 and an axial movement element 704. The rotational element 702 may be operably connected to a motor rotor or a motor stator of a drive system of a pulser assembly and may be rotationally driven thereby. The axial movement element 704 is operably connected to the rotational element 702 and configured such that rotational movement of the rotational element 702 causes an axial movement of the axial movement element 704. The axial movement element 704 is operably coupled to or otherwise connected to a drive shaft and/or valve rotor to enable axial movement of the drive shaft and/or valve rotor.

The rotational element 702 has a respective body 706 with at least one circularly arranged inclined surface 708 and an axial movement-locking element 710. The inclined surface(s) 708 include a first end 713*a* and a second end 713*b*. The inclined surfaces 708 are configured to enable the transition from rotational movement (of the rotational element 702) to axial movement (of the axial movement element 704). The inclined surfaces 708 are arranged on a side of the rotational element facing the axial movement element 704. The axial movement-locking element 710 ensures that the rotational element 702 does not move axially during rotation or oscillation. The axial movement-locking element 710 is configured to lock the axial movement relative to a housing in which the release assembly is located (e.g., pulser housing). In some embodiments, the axial movement element may be axially locked to the housing and the rotational element may move axially relative to the housing. The axial movement-locking element 710 may be part of an axial movement-locking assembly. The axial movement-locking assembly may include, in some embodiments, a circumferential recess in either the housing 722 and/or the rotational element 702 and a key (e.g. a pin, a block, etc.) either inserted in the recess(es) or fixedly connected to one of the rotational element 702 and the housing 722.

The axial movement element 704 has a respective body 712 with at least one circularly arranged slot 714. The slot(s) 714 of the axial movement element 704 are arranged on a side of the axial movement element 704 facing the rotational element 702. The slot(s) are arranged on the same reference circle as the inclined surfaces 708 of the rotational element 702. That is, when the body 712 of the axial movement element 704 is arranged relative to the body 706 of the rotational element 702, the slots 714 align with the inclined surfaces 708 and define a space therebetween.

One or more rolling bodies 716, e.g. balls, bearings, etc., are inserted and arranged in the slot 714 and within the space between the slots 714 of the axial movement element 704 and the inclined surfaces 708 of the rotational element 702. The slot 714 is also referred to as a rolling body slot or ball slot. The first end 713*a* of an inclined surface 708 may be the lowest point of the rolling bodies 716 on the inclined surfaces 708. The second end 713*b* of the inclined surfaces 708 may be the highest point of the rolling bodies 716 on the inclined surfaces 708. The rolling bodies 716 are secured within the space such that the rolling bodies 716 can rotate and move freely within the space along the inclined surfaces 708 and contact the body 712 of the axial movement element 704 within the slots 714. In some embodiments, the slots 714 may be substantially the same shape or contour as the rolling bodies 716 (e.g., a recess with a spherical shape) to allow rotation of the rolling bodies 716 within the slot 714. In accordance with some non-limiting embodiments, the rolling bodies 716 may have a diameter of 5 mm to 10 mm.

The rolling bodies 716 provide for engagement and coupling between the rotational element 702 and the axial movement element 704. As noted, the rolling bodies 716 are configured to roll along the respective inclined surfaces 708 of the rotational element 702. To ensure an unimpeded contact between the rolling bodies 716 and the inclined surfaces 708 of the rotational element 702, the rotational element 702 and the axial movement element 704 have a common rotation center axis 718. In some embodiments, a bearing block or guide block may be arranged to guide a rotation around the center axis 718, in the axial release assembly 700 or anywhere in the drive system of the pulser assembly. The axial movement element 704 is rotationally locked by at least one locking element 720 (rotation locking element) to a housing 722 which shares the center axis 718 as a center axis. The housing 722 may be a housing of a pulser assembly as shown and described above. The locking element 720, as shown, is a key that engages within a keyway, recess, or slot on the inner surface of the housing 722. It will be appreciated that other types of locking elements and configurations may be employed without departing from the scope of the present disclosure. The rotation locking element 720 may be part of a rotation locking assembly. The rotation locking assembly, in some embodiments, may include an axial recess in either the housing 722 and/or the axial movement element 704 and a key (e.g., feather key, splined key, sliding block/nut, etc.) inserted in the recess(es) or fixedly connected to one of the axial movement element 704 and the housing. In alternative embodiments, the rotation locking assembly may include a tooth spline.

The center axis 718 runs through the reference circles defined by the slots 714 and the inclined surfaces 708 and defines a center point (not shown) of the reference circles. The reference circle defined by the slots 714 and the reference circle defined by the inclined surfaces 708 have the same radius. The distance between the lowest point and the highest point on the inclined surfaces 708 along the reference circle defines a circular length 715 of the inclined surface 708. The projection of the inclined surfaces 708 onto a plane that is normal to the axis 718 form circular arcs. The circular length of the inclined surfaces 708 may be defined by the circular arc measured in angular degrees. In accordance with embodiments of the present disclosure, one inclined surface 708 has a circular length of less than 360 angular degrees. That is, one inclined surface 708 covers only a portion of a full circle. In some embodiments, there may be ten inclined surfaces, substantially equally spaced, on the body 706 of the rotational element 702. Each inclined surface 708 may cover or span about 10 to 36 angular degrees. It will be appreciated that any number of inclined surfaces having any desired angular span may be employed without departing from the scope of the present disclosure.

Due to the incline of the inclined surface 708, each inclined surface 708 represents a portion of a spiral with a spiral radius that is defined by the reference circle. As such, if an inclined surface carries on for more than 360 angular degrees, a spiral would be formed. The inclined surfaces 708 may also be described as a ball track or guide. In a cross section of the inclined surface 708 the shape of the inclined surface corresponds to the shape of the rolling bodies 716 (e.g., an arc of a circle). In other embodiments, the cross-sectional shape of the inclined surfaces may be an arc of an ellipse, for example. The inclined surfaces 708 have at least one radius in a radial direction with respect to the reference circle. The inclined surfaces 708 may have a constant slope along the circular length of the inclined surface 708.

In some embodiments, the slope of the inclined surfaces 708 along the circular length may not be constant but may vary with circular length. In some embodiments, the slope of the inclined surface 708 determines the valve gap variation in dependence to the rotational position of the valve rotor relative to the valve stator of the pulser assembly. Varying the slope along the inclined surfaces 708 allows for a defined variation (e.g., gear ratio) of the valve gap with relative rotation of the valve rotor and the valve stator (e.g., angular displacement). A constant slope will result in a linear relation between the valve gap variation (mm) and the valve rotor rotation (angular degrees). A varying slope (e.g., non-linear slope) will result in a non-linear relation between the valve gap variation and the valve rotor rotation. It will be appreciated that all inclined surfaces on the rotational element have the same constant slope or have the same slope variation along the circular length of the inclined surfaces (i.e., each of the inclined surfaces is the same). In accordance with embodiments of the present disclosure, the number of inclined surfaces 708 and the number of rolling bodies 716 is equal.

In operation, when the rotational element 702 is rotated around the center axis 718, the rolling bodies 716 are caused to roll along the inclined surfaces 708, guided by the slots 714. The up and down movement of the rolling bodies 716 along the inclined surfaces 708 is transferred to the body 704 of the axial movement element 704. Thus, the axial movement element 704 may be moved in the positive or negative axial direction along the center axis 718. Moving the rolling bodies 716 up the inclined surfaces 708 results in an extension of the axial release assembly 700. Moving the rolling bodies 716 down the inclined surfaces 708 results in a retraction of the axial release assembly. In an alternative embodiment, the slot(s) 714 may be arranged on a side of the rotational element 702, facing the axial movement element 704 and the inclined surface(s) 708 may be arranged on the axial movement element 704 facing the rotational element 702.

Figure 8:
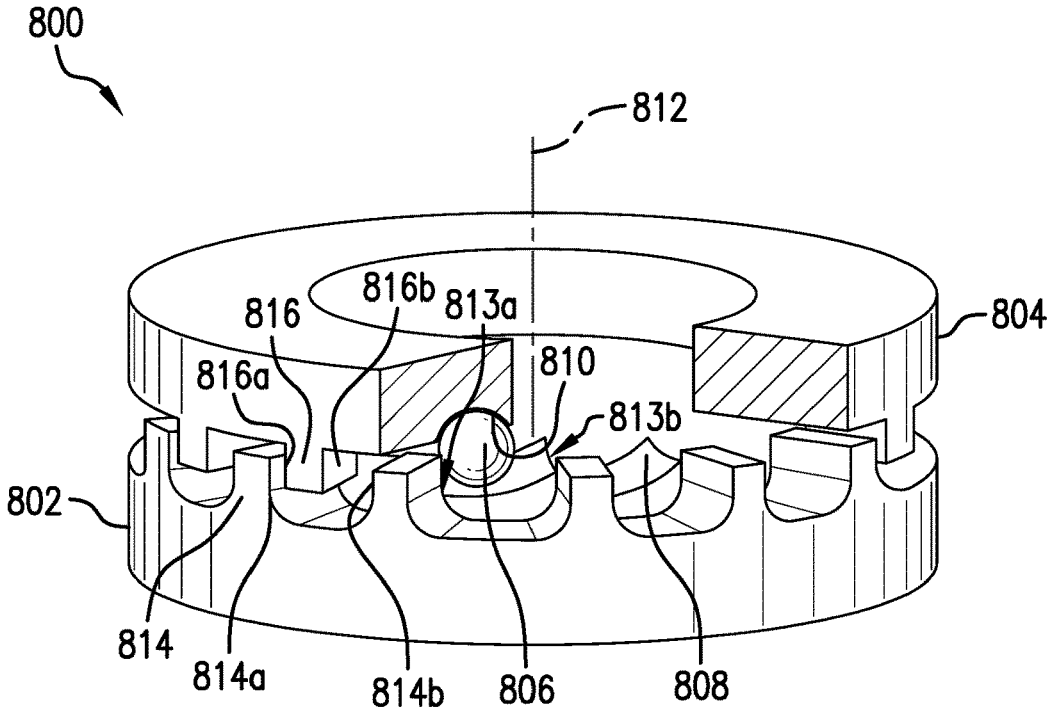
FIG. 8 is a schematic illustration of an axial release assembly in accordance with an embodiment of the present disclosure.

Turning now to FIG. 8, a schematic illustration of an axial release assembly 800 in accordance with an embodiment of the present disclosure is shown. The axial release assembly 800 includes a rotational element 802 and an axial movement element 804. The rotational element 802 may be operably connected to a motor rotor or a motor stator of a drive system of a pulser assembly and may be rotationally driven thereby. The rotational element 802 is configured to rotate relative to a housing which houses the axial release assembly 800, such as a pulser housing. The axial movement element 804 is operably connected to the rotational element 802 and configured such that rotational movement of the rotational element 802 causes an axial movement of the axial movement element 804 relative to the pulser housing. The axial movement element 804 is operably coupled to or otherwise connected to a drive shaft and/or valve rotor to enable axial movement of the drive shaft and/or valve rotor. The axial movement element 804 may not rotate with the drive shaft but may be rotationally stationary with respect to the pulser housing. The drive shaft is configured to rotate relative to the axial movement element 804.

The axial release assembly 800, as shown in FIG. 8, includes rolling bodies 806 that are moveable along inclined surfaces 808 of the rotational element 802 and within slots 810 of the axial movement element 804, as shown and described above. The inclined surfaces 808 include a first end 813*a* and a second end 813*b*. The first end 813*a* may be the lowest point of the rolling bodies 806 on the inclined surfaces 808 and the second end 813*b* may be the highest point of the rolling bodies 806 in the inclined surfaces 808. The lowest point refers to a position of the rolling bodies 806 on the inclined surface 808 that relates to a retracted state of the axial release assembly 800. The highest point refers to a position of the rolling bodies 806 on the inclined surfaces 808 that relates to an extended state of the axial release assembly 800. The rotational element 802 is rotatable about a center axis 812 and the axial movement element 804 is moveable along the center axis 812. In accordance with some embodiments of the present disclosure, the slope of the inclined surface leads to an axial displacement of the rolling bodies when moving from the first end of the inclined surfaces to the second end of the inclined surfaces (e.g., stroke of the axial release assembly). The axial displacement may be between 0.1 mm to 5 mm. More specifically, the axial displacement may be between 0.2 mm to 3 mm. In an alternative embodiment, the axial displacement may be between 0.2 mm to 0.7 mm. In yet another embodiment, the axial displacement may be between 0.4 mm and 0.6 mm.

In this configuration, the rotational element 802 includes a first end stop 814 and the axial movement element 804 includes a second end stop 816. The first end stop 814 includes a first end stop surface 814*a* and a second end stop surface 814*b*. The second end stop 816 includes a first end stop surface 816*a* and a second end stop surface 816*b*. The first end stop 814 and the second end stop 816 form an end stop pair that are configured to stop circumferential motion of the rolling bodies 806 along the inclined surfaces 808 of the rotational body. For example, the end stop pair 814, 816 can prevent a given rolling body 806 from passing over an end of an inclined surface 806 and fall into/onto the next/ adjacent inclined surface 808. The end stop pair 814, 816 is configured to stop further rotation of the rotational element 802 relative to the axial movement element 804. When first end stop surfaces 814*a*, 816*a* of the end stops 814, 816 contact, rotation of the rotational element 802 about the center axis 812 may be prevented or may be directly transferred to the axial movement element 804, in case the axial movement element 804 is rotatable and is not locked with respect to rotation by a rotation locking element or other means of rotational fixation. In contrast, if second surfaces 814*b*, 816*b* contact, a positive rotation of the rotational element 802 about the center axis 812 can be stopped or transferred to the axial movement element 804. In some embodiments, the axial displacement of the axial movement element 804 along the direction of the center axis 812 may be limited using the end stops 814, 816.

When the first end stop surfaces 814*a*, 816*a* contact, the rolling bodies 806 are at the lowest point (e.g., first end 813*a*) of the inclined surfaces 808 and the axial release assembly 800 is fully retracted. When the second end stop surfaces 814*b*, 816*b* contact, the rolling bodies 806 are at the highest point (e.g., second end 813*b*) of the inclined surfaces 808 and the axial release assembly 800 is fully extended. The axial length of the end stops 814, 816 are at least as long as a stroke length (e.g., difference between a fully extended state and a fully retracted stated). In an alternative embodiment, the inclined surfaces 808 may be inclined in the opposite rotational direction. Consequently, the rolling bodies 806 would be at the highest point of the inclined surfaces 808 and the axial release assembly would be fully extended when first end stop surfaces 814*a*, 816*a* contact. Similarly, the rolling bodies 806 would be at the lowest point of the inclined surfaces 808 and the axial release assembly would be fully retracted when second end stop surfaces 814*b*, 816*b* contact. In the fully retracted state, the gap between the rotational element 802 and the axial movement element 804, and thus between the valve stator and the valve rotor (e.g., valve gap), is at a minimum. In the fully extended state, the gap between the rotational element 802 and the axial movement element 804, and thus between the valve stator and the valve rotor, is at a maximum. In an alternative embodiment, the end stop pairs 814/816 may be replaced by end stops on the inclined surfaces 808 on the first end 813*a* and the second end 813*b*, respectively.

Figure 9:
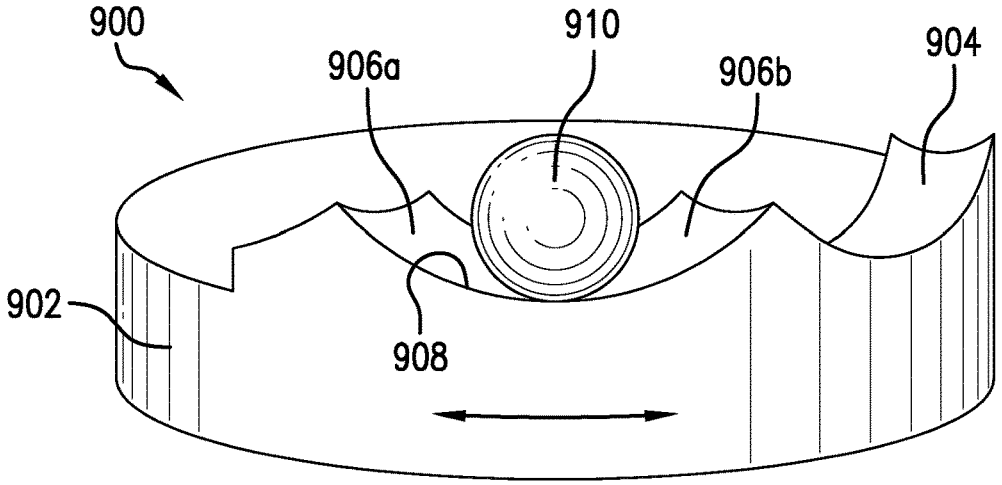
FIG. 9 is a schematic illustration of a portion of an axial release assembly in accordance with an embodiment of the present disclosure.

Turning now to FIG. 9, a schematic illustration of a portion of an axial release assembly 900 in accordance with an embodiment of the present disclosure is shown. FIG. 9 illustrates a configuration of a rotational element 902 that may be employed in various embodiments of the present disclosure. The rotational element 902 may be connected to a motor rotor or a motor stator of a drive system of a pulser assembly and may be rotationally driven thereby. As shown, the rotational element 902 includes inclined surfaces 904 including a first end and a second end and a circular length from the first end to the second end. However, rather than being inclined in one direction, the inclined surfaces 904 include a symmetrical configuration that includes a first and a second end relating to two peaks 906*a*, 906*b* (first peak or first highest point 906*a* and second peak or second highest point 906*b*) and an inflection point 908 (e.g., lowest point) located therebetween. Thus, the two peaks 906*a*, 906*b* form a mirrored incline about the inflection point 908. In some configurations, the inflection point 908 may be an initial position of the system (i.e., when no torque or rotation is applied to the rotational element 902). A rolling body 910 can thus increase along an incline in both positive and negative rotational directions of the rotational element 902. This allows the rolling body 910 to urge an engaged axial movement element away from the rotational body 902 in both directions of oscillation. When the rolling body 910 is located at the inflection point 908, an engaged axial movement element will be located closest to the rotational element 902 and the axial release assembly 900 is fully retracted. Thus, when the rolling body 910 is located at the inflection point 908, a gap between a valve stator and valve rotor may be at a minimum and when the rolling body 910 is located at either peak 906*a*, 906*b*, a gap between a valve stator and valve rotor may be at a maximum.

In an alternative embodiment, the inclined surfaces may not be symmetric with respect to the inflection point but may be asymmetric. The incline of the inclined surface from the inflection point toward the first end may be different to the incline of the inclined surface from the inflection point toward the second end. In another embodiment or in combination therewith, the circular length of the inclined surface between the inflection point and the first end or first highest point may differ from the circular length between the inflection point and the second end or second highest point. Further, in some embodiments, the inclined surfaces may not have a slope on one side of the inflection point. In some embodiments, the axial release element can also serve as a bearing element. As such, the number of rolling bodies may be critical to such functionality. An asymmetric embodiment or configuration would only allow for a small number of rolling bodies. Therefore, splitting-up the symmetric movement into the two rotational directions from the initial position by utilizing two axial movement elements may be beneficial. The bearing functionality of the axial release assembly allows for keeping the friction forces low during relative movement of the included parts (e.g., rotational element, axial movement element, rolling bodies). The axial release assembly and all included parts are easier to manufacture in comparison to spindle configurations used in other configurations. The axial release assembly as disclosed here allows for a non-linear relationship between rotational movement and axial movement. In the axial release assemblies of the present disclosure, axial forces may be distributed among the rolling bodies (e.g., 10 rolling bodies result in 1/10 of the axial force on one rolling body). In accordance with some embodiments of the present disclosure, and without limitation, the axial release assembly may be manufactured from metal (e.g., steel), ceramics, alloys, plastic/synthetic materials, composite materials, or the like. Further, for example, in some embodiments, the inclined surfaces may be coated or hardened. Additionally, in some embodiments, the different parts of the axial release assembly may be manufactured by additive manufacturing.

Figure 10:
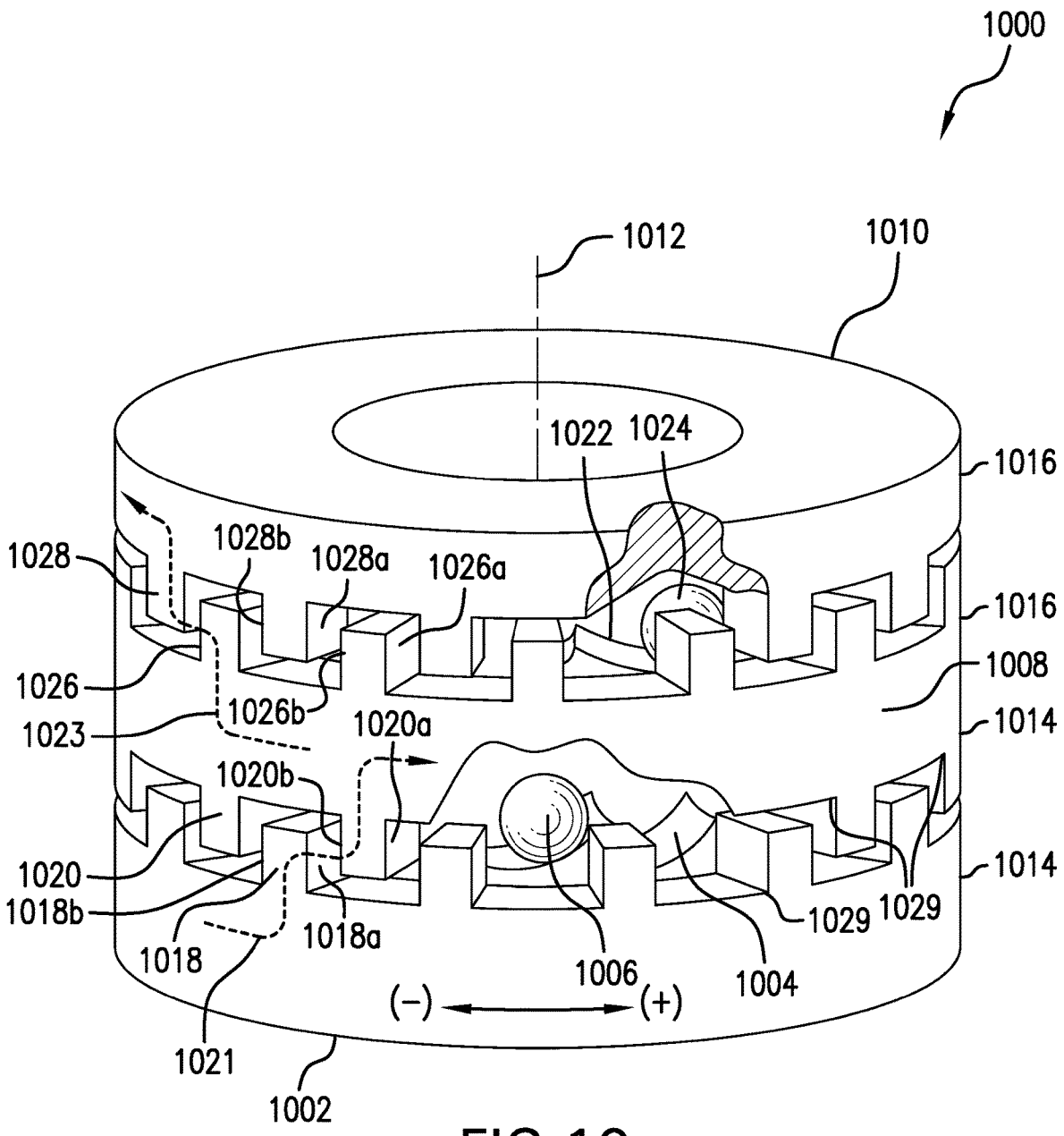
FIG. 10 is a schematic illustration of an axial release assembly in accordance with an embodiment of the present disclosure.

For example, turning now to FIG. 10, schematic illustrations of a portion of an axial release assembly 1000 in accordance with an embodiment of the present disclosure is shown. FIG. 10 illustrates a configuration of a rotational element 1002 that may be employed in various embodiments of the present disclosure. The rotational element 1002 may be operably connected to a motor rotor or a motor stator of a drive system of a pulser assembly and may be rotationally driven thereby. As shown, the rotational element 1002 includes inclined surfaces 1004 upon which, in this embodiment, primary rolling bodies 1006 may roll or move, as described above. The axial release assembly 1000 may be located in a housing (not shown) of a pulser assembly (e.g., pulser housing). The rotationally element 1002 is configured to rotationally move relative to the pulser housing while axial movement is prevented (e.g., use of a locking element for rotational movement as shown in FIG. 7). The pulser assembly may include or define a longitudinal axis 1012, also referred to as a center axis, as described above. The longitudinal axis 1012 defines a rotational symmetry axis of the axial release assembly 1000.

In this configuration, the axial release assembly 1000 includes two axial movement elements, with a first axial movement element 1008 arranged adjacent to the rotational element 1002, and a second axial movement element 1010 arranged adjacent to the first axial movement element 1008. The rotational element 1002 and the second axial movement element 1010 are arranged on opposite axial sides (e.g., along axis 1012) with respect to the first axial movement element 1008. As such, the first axial movement element 1008 is positioned between the rotational element 1002 and the second axial movement element 1010. The first axial movement element 1008 is configured to rotationally and axially move relative to the pulser housing (e.g., with no locking element). The second axial movement element 1010 is configured to axially move relative to the pulser housing while rotational movement relative to the pulser housing is prevented (e.g., use of a locking element for rotational movement as shown in FIG. 7). The axial release assembly 1000 can thus provide for a bi-directional axial movement, based on the axial movement (i.e., along axis 1012) of the two axial movement elements. The axial release assembly includes a central passage. The central passage passes through the axial release assembly along the axis $A_x$. The central passage passes through the rotational element, the first axial movement element, and the second axial movement element. The motor rotor, or alternatively a drive shaft, may run through the central passage connecting a valve rotor with the motor. Thereby the axial release assembly may be configured to surround the motor rotor or the drive shaft.

In operation, the axial release assembly 1000 is configured such that an increase/decrease of the axial distance between the rotational element 1002 and the second axial movement element 1010 and/or the first axial movement element 1008 due to a positive (+) and/or negative (−) rotation direction of the rotational element 1002, about the center axis 1012 is realized by the different axial movement elements 1008, 1010. In some configurations, as shown, the first axial movement element 1008 and the rotational element 1002 define a first axial movement pair 1014 and the first axial movement element 1008 and the second axial movement element 1010 define a second axial movement pair 1016. The inclined surfaces 1004 in the rotational element 1002 are on an axial side (axis 1012) of the rotational element 1002 that faces the first axial movement element 1008.

The rotational element 1002 has end stops 1018 that are configured to transfer a positive (+) applied torque to the first axial movement element 1008. The torque may originate from a drive system or motor of a pulser assembly that is operably connected to the rotational element 1002, as described above. The rolling bodies 1006 are moveable along the inclined surface 1004 and are arranged to freely move within slots (not shown) in the first axial movement element 1008. The slots in the first axial movement element 1008 are on a side of the first axial movement element 1008 facing the rotational element 1002. The first axial movement element 1008 includes respective end stops 1020 that are configured to engage with the end stops 1018 of the rotational element 1002. The end stops 1020 are located on the axial side of the first axial movement element 1008 facing the rotational element 1002 and include end stop surfaces 1020*a*, 1020*b*. The end stops 1018 are located on the axial side of the rotational element 1002 facing the first axial movement element 1008 and include end stop surfaces 1018*a*, 1018*b*. The end stops 1018, 1020 engage when the rotational element 1002 rotates in a positive (+) rotational direction. As the rotational element 1002 rotates, the end stops 1018 of the rotational element 1002 will contact and apply or transfer a torque to the first axial movement element 1008 through the end stops 1020 of the first axial movement element 1008, thus rotating the first axial movement element 1008 about the center axis 1012. That is, in this operation, the end stop surfaces 1018*a*, 1020*b* will contact for transmission of force. A positive force transmission line 1021 is shown in FIG. 10.

The first axial movement element 1008 includes respective inclined surfaces 1022 with rolling bodies 1024 arranged thereon. The inclined surfaces 1022 of the first axial movement element 1008 are on the axial side of the axial movement element 1008 facing the second axial movement element 1010. The rolling bodies 1024 are moveable along the inclined surfaces 1022 and are arranged to freely move within slots (not shown) of the second axial movement element 1010, as described above. The slots of the second axial movement element 1010 are arranged on an axial side of the second axial movement element 1010 facing the first axial movement element 1008. In an initial position, the rolling bodies 1006, 1024 are at a lowest point of the inclined surfaces 1004, 1022, respectively. The rolling bodies 1024 are movable along the inclined surfaces 1022 to move up the inclined surfaces 1022 when the first axial movement element 1008 is rotated by the rotation of the rotational element 1002 and by torque transfer through the end stop surfaces 1018*a*, 1020*b*. The rolling bodies 1024 moving along the inclined surfaces 1022 move the second axial movement element 1010 axially away from the first axial movement element 1008 and the rotational element 1002. As such, the second axial movement pair 1016 will extend. The rotation of the rotational element 1002 and the axial movement element 1008 stops when end stops 1026 and 1028 make contact at end stop surfaces 1026*a*, 1028*b*, and the rolling bodies 1024 reach a highest point on the inclined surfaces 1022. In this state, the axial release assembly 1000 is fully extended and the second axial movement pair 1016 is fully extended. No further relative rotation in the positive (+) direction between the rotational element 1002, the first axial movement element 1008, and the second axial movement element 1010 is possible due to the end stops 1018, 1020 between the first axial movement pair 1014 engaging and the end stops 1026, 1028 between the second axial movement pair 1016 engaging. Thus, as the first axial movement element 1008 is rotated, by means of the rotational element 1002 and the interaction of the end stops 1018, 1020 thereof, the second axial movement element 1010 may be caused to move axially along the center axis 1012. The end stops 1026 are located on an axial side of the first axial movement element 1008 facing the second axial movement element 1010. The end stops 1028 are located on an axial side of the second axial movement element 1010 facing the first axial movement element 1008.

Rotating the rotational element 1002 to the negative (−) rotation direction opens the contact between the end stop surfaces 1018*a*, 1020*b* of the end stops 1018, 1020, respectively. Due to gravitational forces (e.g., weight of the second axial movement element 1010) or a force applied by a biasing member, the rolling bodies 1024 move down the inclined surfaces 1022 and the second axial movement element 1010 moves back axially toward the first axial movement element 1008 and the rotational element 1002. The rolling bodies 1024 moving down the inclined surfaces

1022 makes the first axial movement element 1008 rotate in the negative (−) rotational direction, following the rotation of the rotational element 1002 in the negative (−) direction. When the rolling bodies 1024 reach the lowest point of the inclined surfaces 1022 of the first axial movement element 1008, the end stops 1026, 1028 make contact at the end stop surfaces 1026*b*, 1028*a*. The axial release assembly 1000 is thus returned to its initial position and is fully retracted. The second axial movement pair 1016 is fully retracted. When the rotational element 1002 moves from the initial position to the negative (−) rotational direction, the rolling bodies 1006 between the rotational element 1002 and the first axial movement element 1008 move from the lowest point on the inclined surfaces 1004 of the first axial movement element 1008 up the inclined surfaces 1004. The required torque (negative direction) is established via a negative force transmission line 1023 through the end stop surfaces 1026*b*, 1028*a* of the first and second axial movement elements 1008, 1010, respectively. The first axial movement element 1008 is moved axially away from the rotational element 1002 and with it the second axial movement element 1010. When the rolling bodies 1006 reach the highest point on the inclined surfaces 1004, the end stops 1018, 1020 engage and the end stop surfaces 1018*b*, 1020*a* make contact. The axial release assembly 1000 is thus fully extended. The first axial movement pair 1014 is fully extended. No further relative rotation in the negative (−) direction between the rotational element 1002, the first axial movement element 1008, and the second axial movement element 1010 is possible due to the end stops 1018, 1020 between the first axial movement pair 1014 engaging and the end stops 1026, 1028 between the second axial movement pair 1016 engaging.

Rotating the rotational element 1002 back in the positive (+) direction opens the contact between the contact surfaces 1026*b*, 1028*a*. Due to gravitational forces (e.g., the weight of the first axial movement element 1008 and the second axial movement element 1010) or a force applied by a biasing member, the rolling bodies 1006 move down the inclined surfaces 1004. The first axial movement element 1008, and with it the second axial movement element 1010, axially move back toward the rotational element 1002 until the lowest position on the inclined surfaces 1004 is reached by the rolling bodies 1006, when the end stop surfaces 1018*a*, 1020*b* make contact. The axial release assembly 1000 is returned back to the initial position and is fully retracted, as in the exemplary state of the axial release assembly depicted in FIG. 10. The first axial movement pair 1014 is fully retracted. In the initial position, both the first and the second axial movement pairs 1014, 1016 are fully retracted, wherein in the fully retracted position of the axial release assembly 1000 only one of the axial movement pairs 1014 and 1016 is fully extended.

Because of the rotational movement of the first axial movement element 1008, in this configuration, the first axial movement element 1008 may not be constrained in the rotational direction (e.g., thus lacking a key-slot configuration with respect to rotational with the housing as described above). However, the second axial movement element 1010 may not rotate, and thus may include a key or other rotational stop that engages with the housing of the pulser assembly, as described above. The rotational element 1002, the first axial movement element 1008, and the second axial movement element 1010 share a single center axis 1012 (e.g., rotation axis). The end stop surfaces 1018*a*, 1020*b*, 1018*b*, 1020*a*, 1028*a*, 1026*b*, 1028*b*, 1026*a* of the components are parallel to each other. The center axis 1012 may be perpendicular to the surface normal of the plane defined by the end stop surfaces 1018*a*, 1020*b*, 1018*b*, 1020*a*, 1028*a*, 1026*b*, 1028*b*, 1026*a*.

In some embodiments, the end stop surfaces may be angled with respect to the center axis 1012. The surface normal of the end stop surfaces may have an angle different from 90° relative to the center axis 1012. In some such embodiments, the angled end stop surfaces may provide for an effective torque transfer from one end stop to an adjacent end stop. The angle of the angled end stop surfaces may correspond to the slope of the inclined surfaces on the corresponding element (e.g., rotational element or axial movement element), such that a force action on the end stop element is normal to the end stop surfaces. Such angled end stop surfaces on the end stops may be located on the end stop side that transfers torque (e.g., torque transmission line 1021, 1023). In some alternative embodiments, both sides of the end stops may include angled end stop surfaces. Referring again to FIG. 10, a base 1029 of the end stops (i.e., connection to the axial movement element or rotational element) may not have sharp edges or corners (as illustrated), but may include a rounded, faceted, or curved transition (e.g., one or more radii) from the end stop to the bulk material of the associated component/element. The axial release assembly 1000 in FIG. 10 includes one rotational element and two axial movement elements. However, in other embodiments of the present disclosure, the axial release assemblies may have more than two axial movement element (e.g., 3, 4, 5, 6, or more) and-or more than two axial movement pairs (e.g., 3, 4, or more). In other embodiments, the axial release assemblies of the present disclosure may have more than one rotational element (e.g. 2 or more). In some embodiments, the axial release assembly may not include an axial release assembly housing. Axial movement of portions of the axial release assembly 1000 may be restricted by components of a pulser assembly in which the axial release assembly may be located (e.g., such as locking elements or biasing members). Lateral movement of portions of the axial release assembly to each other (e.g., rotational element, first and second axial movement elements, rolling bodies, etc.) may be restricted by the shape of the slots and the shape of the inclined surfaces 1004, 1022. The rolling bodies 1024 placed in the slots and on the inclined surfaces are configured to restrict lateral movement of the portions of the axial release assembly to each other. In an alternative embodiment, movement (e.g., axial and lateral) of the different portions of the axial release assembly to each other may be restricted by a cage (e.g., a housing) or a similarly acting feature, structure, or mechanism.

Figure 11:
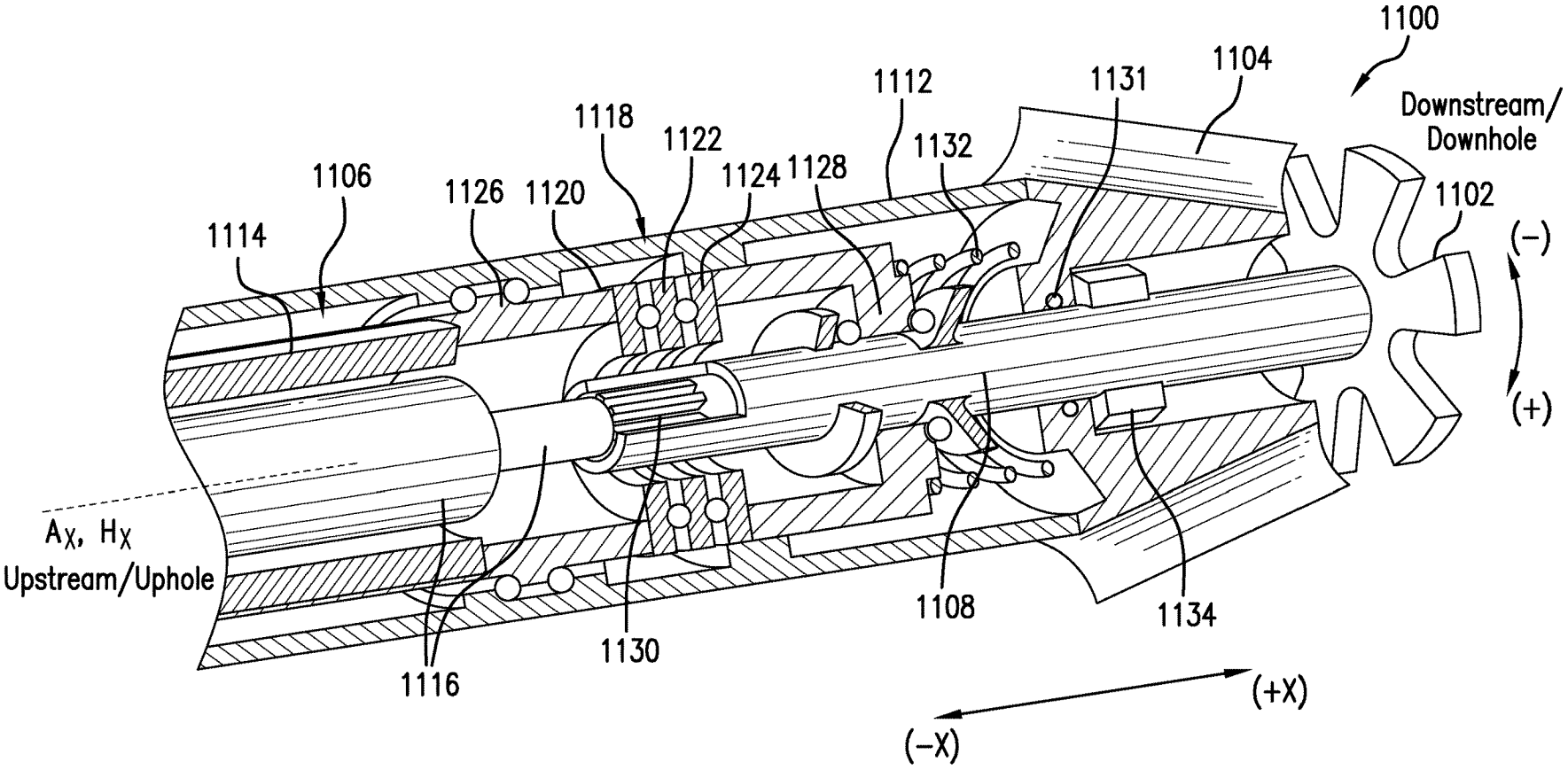
FIG. 11 is a schematic illustration of a pulser assembly in accordance with an embodiment of the present disclosure.

Turning now to FIG. 11, a schematic illustration of a pulser assembly 1100 in accordance with the present disclosure is shown. The pulser assembly 1100 includes a valve rotor 1102 that is moveable (rotationally) relative to a valve stator 1104. The valve rotor 1102 may be configured to selectively obstruct one or more flow passages of the valve stator 1104, as described above. In the configuration of FIG. 11, the valve stator 1104 is arranged upstream from the valve rotor 1102. The valve rotor 1102 may be driven in an oscillatory fashion (as compared to full rotations) by a motor 1106. The motor 1106 may be an electric motor that drives a drive shaft 1108 that is operably coupled to the valve rotor 1102 and enables and drives oscillatory motion of the valve rotor 1102. The motor 1106 and the drive shaft 1108 are contained within a pulser housing 1112 that protects such components (and other components) from a drilling fluid passing along and through the pulser assembly 1100, as described above. Operably coupled to the drive shaft 1108 may be a torsional spring, which may be housed within the pulser housing 1112, as shown and described above. The motor 1106, as shown, includes a motor stator 1114 and a motor rotor 1116, with the motor rotor 1116 operably coupled to the drive shaft 1108. The pulser assembly 1100 may be included in a downhole tool. Such downhole tools include a tool housing (not shown) which can contain the pulser assembly 1100. The tool housing and the pulser assembly may share the same center axis $H_x$, $A_x$. The center axes $A_x$, $H_x$ may be the rotational symmetry axes of the tool housing and the pulser housing 1112, respectively. Between the pulser housing 1112 and the tool housing may be an annular space allowing drilling fluid to flow around the pulser assembly 1100. In some embodiments, the center axes $H_x$, $A_x$ may not coincide.

Arranged between the motor 1106 and the rotor 1102 is an axial release assembly 1118. The axial release assembly 1118 may be similar to that shown and described in FIG. 10, having a rotational element 1120, a first axial movement element 1122, and a second axial movement element 1124. The rotational element 1120 is coupled to the motor 1106 by a bearing 1126 (e.g., a radial bearing). The bearing 1126 may enable mounting of the motor stator 1114 of the motor 1106 within the pulser housing 1112.

As noted, the motor stator 1114 is mounted by a bearing 1126 in the pulser housing 1112. If the motor stator 1114 rotates, the rotation is transmitted to the axial release assembly 1118, which generates an axial movement, as described above. The axial movement of the axial release assembly 1118 will cause a drive shaft mounting 1128 (e.g., a radial bearing) to move in an axial direction (i.e., downstream toward the valve rotor 1102). The axial movement of the drive shaft mounting 1128 will cause the drive shaft 1108 to move axially. The axial movement of the drive shaft 1108 will thus cause an axial movement of the valve rotor 1102. By this, an axial valve gap between the valve stator 1104 and the valve rotor 1102 may be adjusted or otherwise controlled. To enable the axial movement of the drive shaft 1108, the motor rotor 1116 and the drive shaft 1108 may be axially free-coupled by a sliding seat 1130, dividing the motor rotor 1116 and the drive shaft 1108 axially. The sliding seat 1130 allows for transmission of torque from the motor rotor 1116 to the drive shaft 1108, while allowing axial movement between the motor rotor 1116 and the drive shaft 1108. In this illustrative embodiment, the axial movement of the drive shaft 1108 can be restrained or biased by biasing member 1132 (e.g., a drive shaft spring).

In accordance with embodiments of the present disclosure, the biasing member 1132 may either bias a movement of the drive shaft 1108 in an axial direction that increases the valve gap or may bias the movement of the drive shaft 1108 in an axial direction that decreases the valve gap. The drive shaft 1108 runs through valve stator 1104. A radial bearing (not shown) between the drive shaft 1108 and the valve stator 1104 may facilitate relative rotation between the drive shaft 1108 and the valve stator 1104. A drive shaft seal 1131 between the valve stator 1104 and the drive shaft 1108 may seal an inner space within the pulser housing 1112 from drilling mud to enter from a downstream end of the pulser assembly 1100. On the upstream end of the pulser assembly 1100 another seal (not shown) may seal the space inside the pulser housing 1112 from drilling mud to enter from the upstream end of the pulser assembly 1100. The seal on the upstream end may be included in a flow diverter (not shown) that redirects the drilling mud flowing through an inner bore of a drill tubular or BHA to pass the pulser assembly 1100 through the annular space between the pulser housing 1112 and the tool housing. In some embodiments, the flow diverter may secure the uphole end of the pulser assembly to the tool housing to prevent radial and axial movement of the pulser assembly relative to the tool housing.

If a torque is applied to the drive system (e.g., motor 1106), the torque can be transferred to the drive shaft 1108 and the axial release assembly 1118. Torque may be applied to the motor stator 1114 of the motor 1106 when particles in the drilling mud obstruct the valve and the rotation of the motor rotor 1116. The motion behavior may depend upon the stiffness of the drive shaft spring 1132 and a gear ratio of the axial release assembly 1118 (e.g., slope of the inclined surfaces, axial movement per angular displacement angle (mm/angular degree)), a torsional spring (not shown) that is operably connected to the motor rotor 1116 and/or the drive shaft 1108, a load (toque) on the valve rotor, and a position of a valve end stop 1134 that constrains rotational movement of the drive shaft 1108. If torque is applied to the motor stator 1114, which is rotationally freely mounted in the pulser housing 1112, the motor stator may rotate in a positive (+) rotational direction relative to the pulser housing 1112 and transfer a rotating in the positive (+) rotational direction through the bearing 1126 to the rotational element 1120. The rotational element 1120 rotates from an initial position to the positive (+) rotational direction. As described with respect to FIG. 10, a positive (+) rotational direction of rotational element 1120 causes the second axial release assembly 1118 to extend and to move the second axial movement element 1124 axially relative to the pulser housing 1112 (e.g., positive (+x) direction). Axial movement of the second axial movement element 1124 is transferred through the drive shaft mounting 1128 to the drive shaft 1108. The drive shaft 1108 axially moves in a downstream direction (+x) and the valve gap between the valve rotor 1102 and the valve stator 1104 increases by a distance that depends on the angular displacement angle of the rotational element 1120 relative to the pulser housing 1112 either partially or fully (maximum axial extension of the axial release assembly). The valve gap increases and the particles obstructing the oscillation of the valve rotor 1102 are released and washed away by the flowing drilling mud (not shown). If torque is applied to the motor stator 1114 in a negative (−) rotational direction, the motor stator rotates 1114 in the negative (−) rotational direction relative to the pulser housing 1112 and transfers rotation in the negative (−) rotational direction through the bearing 1126 to the rotational element 1120. The rotation in the negative (−) rotational direction of the rotational element 1120 causes the first axial movement element 1122 to extend and to move second axial movement element 1124 axially relative to the pulser housing (+x). The valve gap increases and the particles obstructing the oscillation of the valve rotor 1102 are released and washed away by the flowing drilling mud. In this embodiment the second axial movement element 1124 may be rotationally locked with the pulser housing 1112.

Accordingly, an oscillation system (e.g., pulser assembly 1100) enabling both rotational oscillation (by means of the motor 1106) and axial movement (by means of the axial release assembly 1118) is achieved. A coupling of the oscillation with a torque on the system (e.g., a drive shaft and/or motor stator) is provided. The configuration can be used to prevent plugging of the valve rotor-stator assembly, because an increasing torque can increase the gap between the valve stator 1104 and the valve rotor 1102. As the gap is increased, a lodged particle or other debris may be released from between the valve stator 1104 and the valve rotor 1102. The coupling of the torque to the motor stator 1114 and the amount of axial movement of the drive shaft 1108 and therewith the increase of the valve gap can be adjusted by the parameters of the biasing element 1132 (e.g. a drive shaft spring constant). The sensitivity of the valve gap change to the torque increase on the motor stator 1114 can be adjusted by adjusting the biasing element 1132.

Figure 12:
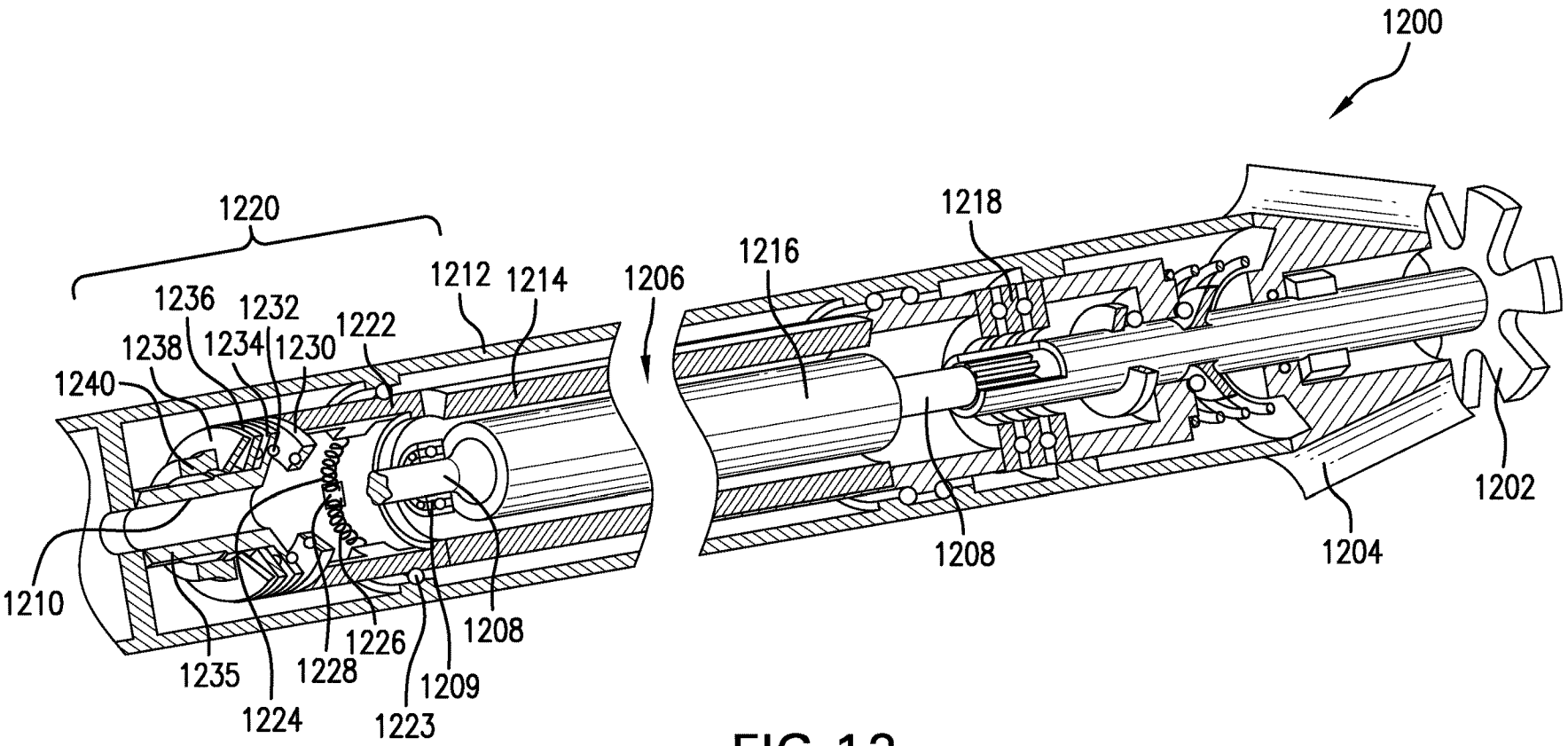
FIG. 12 is a schematic illustration of a pulser assembly in accordance with an embodiment of the present disclosure.

In some embodiments, the systems may be configured to increase a gap between a valve rotor and valve stator based on predefined torque or angle limits. For example, turning to FIG. 12, a schematic illustration of a pulser assembly 1200 in accordance with the present disclosure is shown. The pulser assembly 1200 includes a valve rotor 1202 that is moveable (rotationally) relative to a valve stator 1204. The valve rotor 1202 may be configured to selectively obstruct one or more flow passages of the valve stator 1204, as described above. In the configuration of FIG. 12, the valve stator 1204 is arranged upstream from the valve rotor 1202. The valve rotor 1202 may be driven in an oscillatory fashion by a motor 1206. The motor 1206 may be an electric motor that drives a drive shaft 1208 that is operably coupled to the valve rotor 1202 and enables and drives oscillatory motion of the valve rotor 1202. The drive shaft 1208 may be connected to a pulser housing 1212 by a bearing 1209 (e.g., a radial bearing). The motor 1206 and the drive shaft 1208 are contained within the pulser housing 1212 that protects such components (and other components) from a drilling fluid passing along and through the pulser assembly 1200, as described above. In this embodiment, operably coupled to the drive shaft 1208 may be a clutch assembly 1210, which may be housed within the housing 1212. The motor 1206, as shown, includes a motor stator 1214 and a motor rotor 1216, with the motor rotor 1216 operably coupled to the drive shaft 1208. An axial release assembly 1218 is arranged to enable axial movement of the valve rotor 1202 relative to the valve stator 1204, as shown and described above. In this embodiment, the axial release assembly 1218 is configured similar to that shown in FIGS. 10 and 11, although other configurations of the axial release assembly may be employed without departing from the scope of the present disclosure. The motor stator 1214 may be generally fixedly connected to the housing 1212, and the clutch assembly 1210 may be configured to selectively decouple the fixed connection between the motor stator 1214 and the housing 1212.

In the configuration shown in FIG. 12, the axial release assembly 1218 is linked with a torque control unit 1220 that includes the clutch assembly 1210 (i.e., through the motor stator 1214). Such a configuration enables the separation of the functions of the pulser assembly 1200. That is, the operation to generate pressure pulses can be separated or decoupled from the function to release the valve (i.e., increase a gap between the valve rotor 1202 and the valve stator 1204). The torque control unit 1220 can be adjusted or set to a predefined torque value to activate and/or operate the clutch assembly 1210. When an operational torque is below the predefined torque value, the axial release assembly 1218 is decoupled and cannot cause axial movement of the valve rotor 1202. However, when an operational torque exceeds the predefined torque value, the clutch assembly 1210 may engage, thus decoupling the motor stator 1214 from the housing 1212 and causing the motor stator 1214 to engage with the axial release assembly 1218. As such, the operational torque, in this situation, may be transferred to both the drive shaft 1208 and the axial release assembly 1218.

As noted, the torque control unit 1220 includes the clutch assembly 1210, which may be a torque-depending clutch assembly. The clutch assembly 1210 is connected with the motor stator 1214 by a linking element 1222. The linking element 1222 may be rotationally connected to the pulser housing 1212 by a bearing 1223 (e.g., a radial bearing). To assure that the motor stator 1214 returns to an initial position, after a release cycle (i.e., clutch activation and axial extension) in a defined angular position relative to the drive shaft 1208, one or more bidirectional springs 1224, 1226 are incorporated into the torque control unit 1220. The bidirectional springs 1224, 1226 may be connected with the linking element 1222, the motor stator 1214, or other element of the motor 1206. If the motor stator 1214 rotates, one of the bidirectional springs 1224, 1226 will be compressed toward a spring end stop element 1228, which in turn is part of or connected to the housing 1212. The bidirectional springs 1224, 1226 are configured to generate a reverse or opposing force that urges the motor stator 1214 back toward the initial position (i.e., when the operational torque does not exceed the predefined torque value). In accordance with some embodiments of the present disclosure, the predefined torque value may be between 5 Nm and 20 Nm. In some embodiments, the predefined torque value may be between 8 Nm and 15 Nm. In yet other embodiments, the predefined torque value may be between 9 Nm and 11 Nm.

The torque-depending clutch assembly 1210 can include, for example, a ball disk 1230 having one or more recesses to hold balls 1232. The ball disk 1230 can be fixedly connected to the motor stator 1214 and/or the linking element 1222. A ball carrier 1234 is arranged with holes to enable the balls 1232 to slip through the holes of the ball carrier 1234 to a disk 1236. The disk 1236 has a spring force applied thereto. The spring force applied to the disk 1236 of the clutch assembly 1210 can be provided by a plate spring 1238. The plate spring 1238 may be a pre-compressed spring that is pre-compressed by a nut 1240 which is carried by or threadedly attached to the ball carrier 1234. The nut 1240 and/or the ball carrier 1234 may be supported by a ball carrier support 1235. The ball carrier support 1235 may fixedly be connected to the pulser housing 1212. In a locking position, the balls 1232 are pressed to recesses in the ball disk 1230. However, if the operational torque is increased to a value that exceeds the predefined torque value, the balls 1232 will apply a force in an axial direction, which exceeds the spring force of the plate spring 1238, the balls 1232 will slip or pass through the holes in the ball carrier 1234. With the balls 1232 removed from engagement with the ball carrier 1234, the ball disk 1230 can rotate freely. In some embodiments, to ensure operation occurs at specific positions/angles, the recesses in the ball disk 1230 may be designed such that one ball 1232 can only move into one recess of the ball disk 1230 per direction of rotation. In some embodiments, the clutch assembly 1210 may be located uphole of the motor 1206. In other embodiments, the clutch assembly 1210 may be located downhole of the motor 1206.

Figure 13:
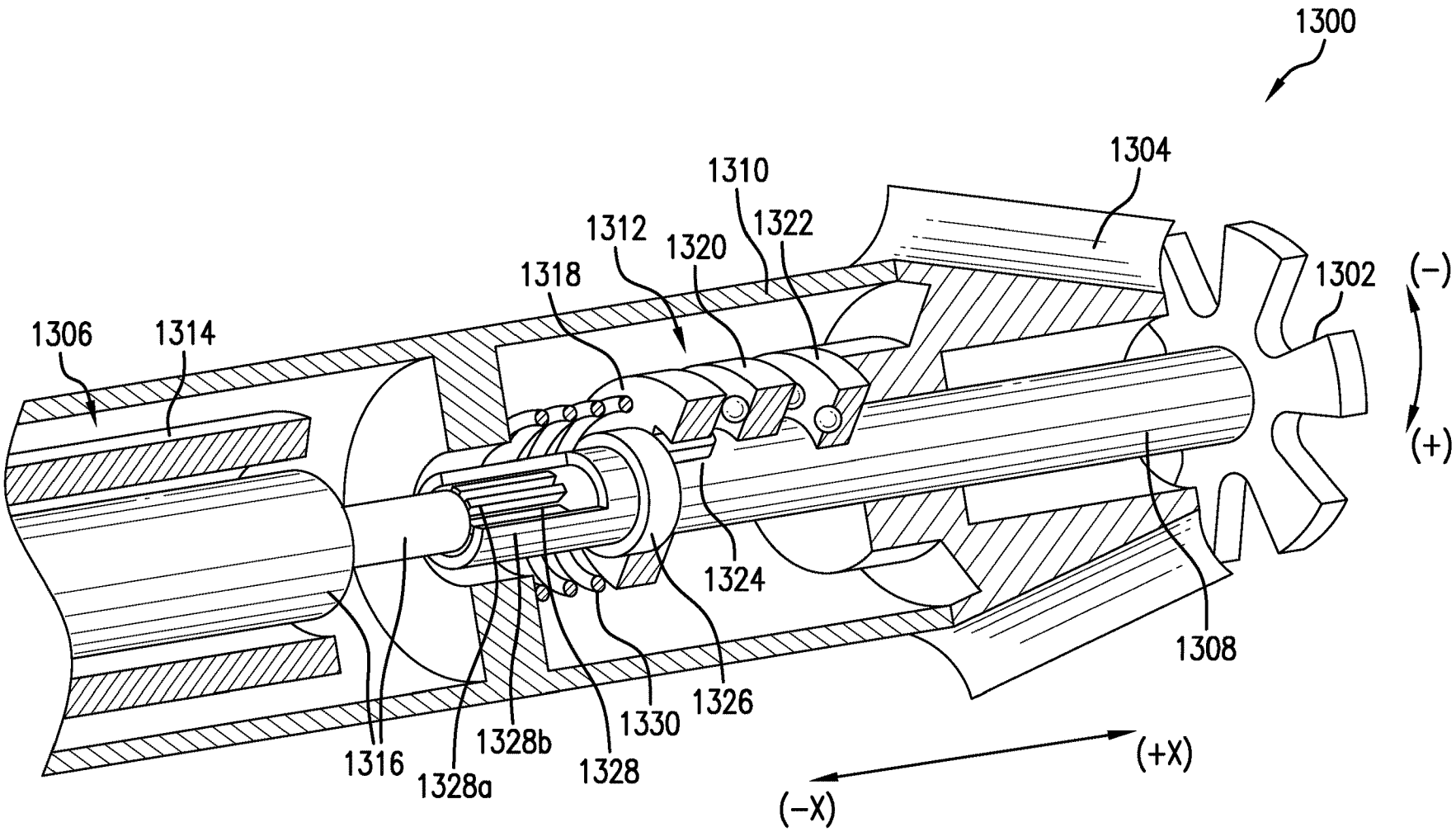
FIG. 13 is a schematic illustration of a pulser assembly in accordance with an embodiment of the present disclosure.

In addition to providing a torque-dependent axial movement mechanism (or alternatively thereto), embodiments of the present disclosure may be angle-dependent. For example, turning to FIG. 13, a schematic illustration of a pulser assembly 1300 in accordance with the present disclosure is shown. The pulser assembly 1300 includes a valve rotor 1302 that is moveable (rotationally) relative to a valve stator 1304. The valve rotor 1302 may be configured to selectively obstruct one or more flow passages of the valve stator 1304. In the configuration of FIG. 13, the valve stator 1304 is arranged upstream from the valve rotor 1302. The valve rotor 1302 may be driven in an oscillatory fashion by a motor 1306. The motor 1306 may be an electric motor that drives a drive shaft 1308 that is operably coupled to the valve rotor 1302 and enables and drives oscillatory motion of the valve rotor 1302. The motor 1306 and the drive shaft 1308 are contained within a pulser housing 1310 that protects such components (and other components) from a drilling fluid passing along and through the pulser assembly 1300. In this embodiment, an axial release assembly 1312 is arranged within the pulser housing 1310 and configured to enable adjustment of a gap between the valve rotor 1302 and the valve stator 1304, as described above. In this illustrative configuration, the axial release assembly 1312 is arranged as a bi-directional configuration, similar to that shown and described with respect to FIGS. 10-11.

The axial release assembly 1312 is operably coupled to the drive shaft 1308 to cause axial movement of the drive shaft 1308 and the valve rotor 1302. The motor 1306, as shown, includes a motor stator 1314 and a motor rotor 1316, with the motor rotor 1316 operably coupled to the drive shaft 1308. In this embodiment, as noted, the axial release assembly 1312 is configured similar to that shown in FIGS. 10 and 11, although other configurations of the axial release assembly may be employed without departing from the scope of the present disclosure.

The axial release assembly 1312 is connected with the drive shaft 1308 to provide an angle-dependent movement of the valve rotor 1302 in a negative axial direction (−x) (i.e., toward the valve stator 1304, and thus decrease the valve gap therebetween). In an initial position where the valve is open (i.e., when the valve rotor 1302 does not block or obstruct the valve stator 1304), there is an axial valve gap between the valve rotor 1302 and the valve stator 1304. When the drive shaft 1308 rotates, the valve rotor 1302 closes or obstructs the flow channels of the valve stator 1304. Synchronous to this rotation, the bi-directional axial release assembly 1312 is configured to generate an axial movement in a negative axial-direction (i.e., the valve rotor 1302 will move toward the valve stator 1304). As a result and due to this, the axial valve gap between the valve rotor 1302 and the valve stator 1304 is decreased when the closure of the valve is increased (i.e., when the valve rotor 1302 increases in obstruction of the flow paths of the valve stator 1304). Thus, in this embodiment, the initial valve gap between the valve rotor 1302 and the valve stator 1304 can be set to a sufficiently large valve gap to prevent plugging or blockage by debris or other particles. A small valve gap can be used to generate an adequate pressure drop when the valve rotor 1302 is near an angular end position (i.e., full extent of driven oscillation, flow passage of the valve stator partially or completely closed). If debris plugging occurs when the valve rotor 1302 is at a full extend, a relatively small angular rotation of the valve rotor 1302 back toward an initial position will automatically increases the axial valve gap between the valve rotor 1302 and the valve stator 1304, and thus any lodged debris or particles will be released.

In this illustrative configuration, the bi-directional axial release assembly 1312 includes a rotational element 1318, a first axial movement element 1320, and a second axial movement element 1322 (e.g., similar to that shown and described in FIGS. 10-11). However, in this embodiment, the second axial movement element 1322 is fixedly connected to the pulser housing 1310. The first and the second axial movement elements 1320, 1322 have slots to receive the rolling bodies, as described above. The rotational element 1318 is rotationally connected with the drive shaft 1308 (e.g., by a key-connection 1324). In the axial direction, the rotational element 1318 (and thus the axial release assembly 1312) is supported by a shaft shoulder 1326 of the drive shaft 1308. If the drive shaft 1308 rotates, the rotational element 1318 interacts with the first axial movement element 1320 of the axial release assembly 1312 and causes movement of the rotational element 1318 in a negative axial direction (−x) due to the movement of the rolling bodies on inclined surfaces of the rotational element 1318 and the first axial movement element 1320, as described above. In some embodiments, and as shown in FIG. 13, the motor 1306 can be retained in a fixed axial position by incorporation of a sliding seat 1328 between the drive shaft 1308 and the motor rotor 1316. The sliding seat 1328 consists of two parts 1328*a*, 1328*b*. A first part 1328*a* of the sliding seat 1328 is connected to the motor rotor 1316 (e.g., a motor rotor sliding seat portion) and a second part 1328*b* of the sliding seal 1328 is connected to the drive shaft 1308 (e.g., a drive shaft sliding seat portion).

In some embodiments, to ensure that the axial release assembly 1312 is kept together in all positions and operations, a flexible retention member 1330 (e.g., a spring) can be employed between (axially) the pulser housing 1310 and the rotational element 1318 of the axial release assembly 1312. The concept described with respect to FIG. 13 may work well with a so called close-to-close pulser. A close-to-close pulser is also referred to as a normally-open pulser. An example of such close-to-close pulsers is described in U.S. patent application Ser. No. 17/126,984, filed Dec. 18, 2020, entitled "Oscillating Shear Valve for Mud Pulse Telemetry and Operation Thereof," which is commonly owned and the contents thereof are incorporated herein in their entirety.

In a close-to-close pulser configuration, and with continued reference to FIG. 13, the valve rotor 1302 oscillates between two closed positions (i.e., a stator passage is closed or blocked by a rotor blade). The reversal point of the rotation in the oscillatory movement of the valve rotor 1302 is at the closed position. The open position of the valve is reached during the transition between the two closed positions. The closed positions correspond to the extended position of the axial release assembly 1312, and the valve gap is decreased or at a minimum. The open position corresponds to the initial position of the axial release assembly 1312, and the valve gap is increased or at a maximum. In an alternative embodiment, the closed position corresponds to the retracted position of the axial release assembly and the open position corresponds to the extended position of the axial release assembly. The system shown in FIG. 13 may be modified to serve an open-to-open pulser. In an open-to-open pulser, with reference to FIG. 13 again, the valve rotor 1302 oscillates between two open positions. The reversal point of the rotation in the oscillatory movement of the valve rotor is at the open position. The closed position of the valve is reached during the transition between the two open positions. In still another embodiment, the initial position may be a half-closed valve position (e.g., the stator passage is half obstructed by a rotor blade). From the initial half-closed position, the valve rotor rotates to a closed position in a positive (+) rotational direction. From the closed position, the valve rotor rotates back in the negative (−) rotational direction to the initial position (half-closed position). From there, the valve rotor continues rotation in the negative (−) rotational direction to the valve open position. In the valve closed position, the valve gap is supposed to be at a minimum.

In the initial position and in the open position the valve gap is supposed to be at a maximum. To achieve such a gap variation with the oscillating valve rotor 1302, the inclining surfaces on the rotational element 1318 or the inclining surfaces on the first axial movement element 1320 may be flat with no slope. The inclining surfaces on the rotational element or the first axial movement element may not incline but be flat surfaces. The inclining surfaces on the other of the rotational element and the first axial movement element may have slopes and may not be flat.

In some embodiments, instead of coupling the rotation of the rotational element to the rotational movement of either the motor stator or the motor rotor (or drive shaft) in a pulser assembly, the rotation required to extend the axial release assembly may be provided by a gap release motor. The gap release motor may be coupled to the rotational element of the axial release assembly and is configured to drive rotation of the rotational element. That is, the motor rotor or motor stator of the gap release motor is operatively coupled to the rotational element. In some embodiments, the gap release motor may be an electric motor. The gap release motor may be controlled by a processor or other controller. The processor may be coupled to a torque sensor. The torque sensor is configured to measure torque on the motor rotor or motor stator of the pulser motor. Depending on the torque measured by the torque sensor, the gap release motor is configured to start rotation of the rotational element to change the valve gap (e.g., increasing, decreasing). In an alternative embodiment, the processor may monitor the power consumption of the pulser motor and may be configured to rotate the rotational element depending on the power consumption and/or current consumption of the pulser motor. Both, (i) the torque on the motor rotor or motor stator of the pulser motor, and (ii) the power or current consumption of the pulser motor relate to the torque acting on the valve rotor in the pulser assembly. Therefore, the rotation provided by the gap release motor to the rotational element depends on the torque on the valve rotor.

An angle-dependent system (e.g., as described with respect to FIG. 13) can be used to modulate a pressure drop across a pulser assembly. Normally, there is a defined characteristic curve between a pressure drop and the angle-position of the valve rotor relative to the valve stator (e.g., the opening amount of the flow paths through the valve stator). However, the shape of this curve depends, in part, on the axial valve gap between the valve rotor and the valve stator. Because embodiments of the present disclosure enable adjusting of the axial valve gap during operation, an additional control of the pressure drop is enabled. That is, by making an axial valve gap adjustment based on rotation enables a free modulation of the pressure drop (i.e., a controlled adjustable valve gap) within the static curves of two different valve gap sizes (e.g., small valve gap, large valve gap).

Figure 14A:
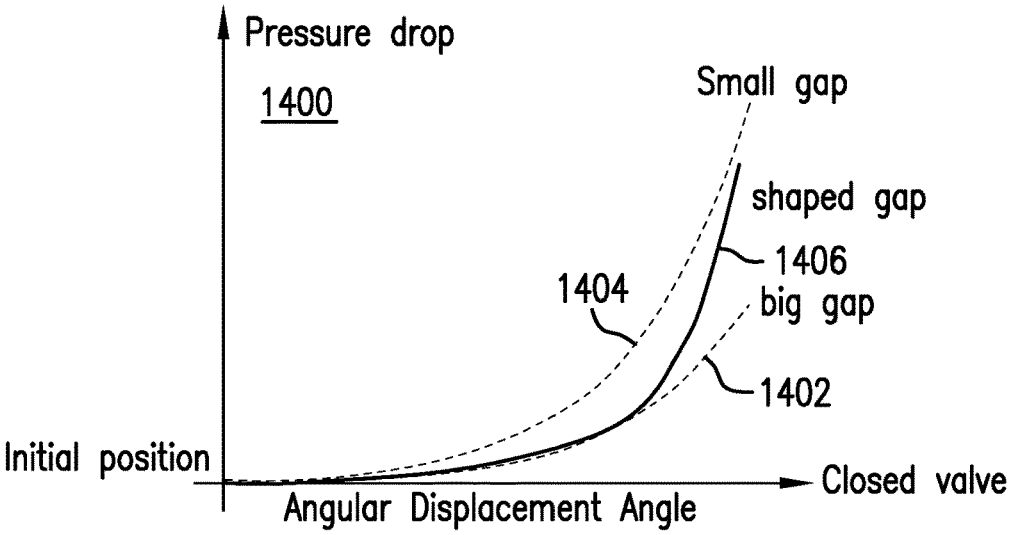
FIG. 14A is a pressure plot illustrating different pressure curves based on separation gap of a valve rotor relative to a valve stator.
Figure 14B:
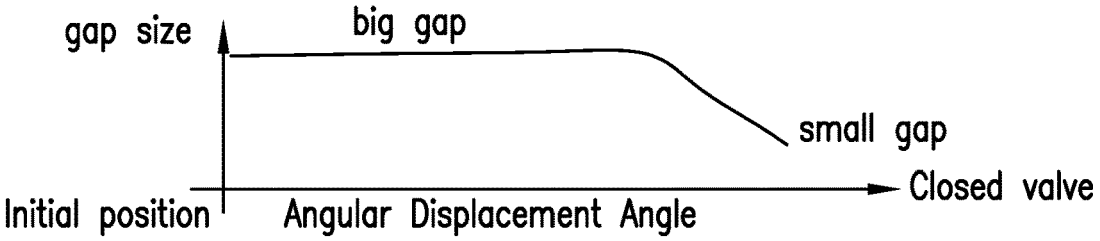
FIG. 14B illustrates a valve gap transition for a system in accordance with an embodiment of the present disclosure.

This is illustratively shown in FIGS. 14A-14B. On plot 1400 of FIG. 14A, a large valve gap curve 1402 and a small valve gap curve 1404 are shown at a specific flow rate (l/min). As shown, for both curves 1402, 1404, as the valve closes (i.e., the valve rotor obstructs more of the flow paths through the valve stator), the pressure drop will increase. However, for each of the curves 1402, 1404, the curve primarily depends on the angular displacement angle (e.g., angular position) of the valve rotor and/or drive shaft. In contrast, by implementing an axial release assembly within a pulser assembly, as shown and described above, variable pressure drops may be achieved, as indicated by curve 1406, which represents a shaped valve gap that is adjusted based on angular position. The corresponding valve gap size is shown in FIG. 14B. Here, the pressure drop also depends upon the valve gap.

Figure 14C:
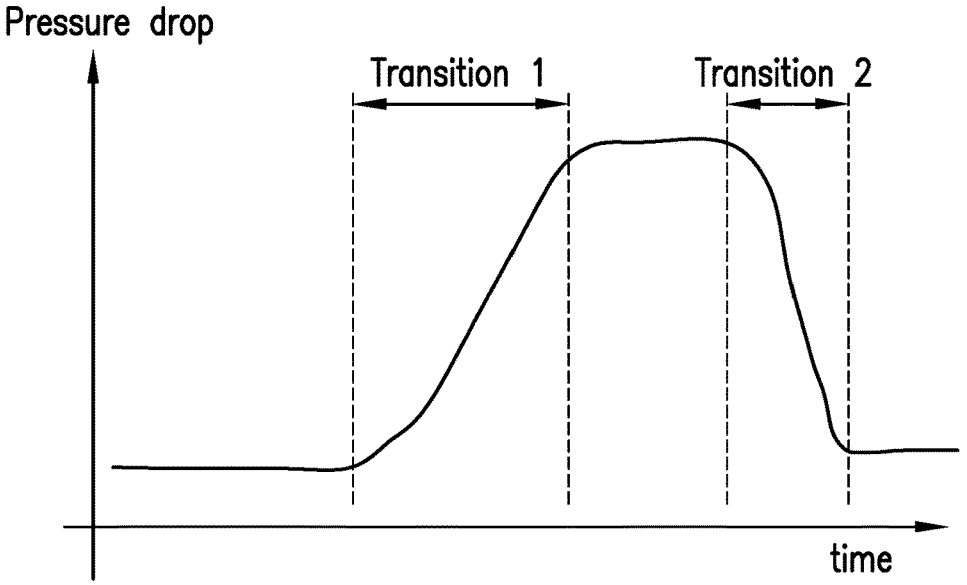
FIG. 14C is a pressure plot versus time as produced by a system in accordance with the present disclosure.

The quality of the pressure wave transmitted downhole depends on the shape of the transition curve over time between two pressure levels, as shown in FIG. 14C. FIG. 14C illustrates two transitions, transition 1 and transition 2. For example, a sinusoidal shape can increase the signal quality. Normally, the transition curve for a system with a fixed valve gap is adjusted by the time-depending shape of the driving cycle. This is additionally influenced by inertia, hydrostatic torque, and retarding and accelerating characteristics of the system. However, using a valve gap-size modulation, as described herein, as an additional degree of freedom can harmonize the characteristic of the drive system (e.g., motor) and the valve rotor and valve stator system and can be used to improve signal quality.

While embodiments described herein have been described with reference to specific figures, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed, but that the present disclosure will include all embodiments falling within the scope of the appended claims or the following description of possible embodiments.

Embodiment 1: A pulser assembly configured to be positioned along a tubular string through which a drilling fluid flows, the pulser assembly comprising: a housing configured to be supported along the tubular string; a valve stator supported by the housing, the valve stator having at least one flow path that extends from an upstream end to a downstream end of the valve stator; a valve rotor positioned adjacent the valve stator, the valve rotor configured to selectively obstruct the at least one flow path, wherein an axial gap is present between the valve rotor and the valve stator; a motor operably coupled to the valve rotor, wherein the motor is operable to rotate the valve rotor relative to the valve stator; and an axial release assembly including a rotational element configured to adjust the axial gap between the valve rotor and the valve stator based on a rotation of the rotational element.

Embodiment 2: The pulser assembly of any preceding embodiment, wherein the axial release assembly further comprises: an axial movement element, wherein rotation of the rotational element relative to the housing causes an axial movement of the axial movement element.

Embodiment 3: The pulser assembly of any preceding embodiment, further comprising a biasing element, the biasing element configured to bias the axial movement of the axial movement element.

Embodiment 4: The pulser assembly of any preceding embodiment, wherein the axial release assembly further comprises at least one rolling body arranged between the rotational element and the axial movement element.

Embodiment 5: The pulser assembly of any preceding embodiment, wherein: one of the rotational element and the axial movement element comprises at least one inclined surface, the other of the rotational element and the axial movement element comprises at least one slot, and the at least one rolling body is arranged within the at least one slot and configured to freely roll within the at least one slot along the at least one inclined surface.

Embodiment 6: The pulser assembly of any preceding embodiment, wherein the at least one inclined surface comprises a symmetrical configuration that includes two peaks and an inflection point located therebetween.

Embodiment 7: The pulser assembly of any preceding embodiment, wherein the rotational element includes a first end stop and the axial movement element includes a second end stop, wherein the first and second end stops are configured to restrict an amount of rotation of the rotational element relative to the axial movement element.

Embodiment 8: The pulser assembly of any preceding embodiment, wherein one of the rotational element and the axial movement element is axially constrained relative to the housing and the other of the rotational element and the axial movement element is rotationally constrained relative to the housing.

Embodiment 9: The pulser assembly of any preceding embodiment, wherein the motor comprises a motor stator and a motor rotor.

Embodiment 10: The pulser assembly of any preceding embodiment, wherein the rotational element is coupled to the motor stator.

Embodiment 11: The pulser assembly of any preceding embodiment, wherein the rotational element is coupled to the motor rotor.

Embodiment 12: The pulser assembly of any preceding embodiment, further comprising a drive shaft operably connecting the motor to the valve rotor, wherein the axial release assembly is configured to adjust an axial position of the drive shaft to adjust the axial gap between the valve rotor and the valve stator.

Embodiment 13: The pulser assembly of any preceding embodiment, wherein the drive shaft is axially free-coupled to a motor rotor by a sliding seat.

Embodiment 14: The pulser assembly of any preceding embodiment, further comprising a clutch assembly configured to selectively operate the axial release assembly based on a torque applied to the valve rotor.

Embodiment 15: The pulser assembly of any preceding embodiment, wherein the axial release assembly is configured such that (i) a rotation of the rotational element in a first rotational direction from an initial position and a rotation in a second rotational direction, opposite the first rotational direction, from an initial position causes the axial gap to increase or (ii) a rotation of the rotational element in a first rotational direction from an initial position and a rotation of the rotational element in a second rotational direction, opposite the first rotational direction, from the initial position causes the axial gap to decrease.

Embodiment 16: The pulser assembly of any preceding embodiment, wherein the axial release assembly comprises: a rotational element; a first axial movement element operably coupled to the rotational element; and a second axial movement element operably coupled to the first axial movement element; wherein rotation of the rotational element causes an axial movement of at least one of the first axial movement element and the second axial movement element.

Embodiment 17: The pulser assembly of any preceding embodiment, wherein the axial release assembly is configured such that a rotation of the rotational element in a first rotational direction from an initial position causes the first axial movement element to axial move relative to the rotational element and a rotation of the rotational element in a second rotational direction, opposite the first rotational direction, from the initial position causes the second axial movement element to axial move relative to the rotational element.

Embodiment 18: The pulser assembly of any preceding embodiment, further comprising a gap release motor, the gap release motor configured to drive the rotation of the rotational element depending on a torque acting on the valve rotor.

Embodiment 19: A method for generating pulses in a drilling fluid, the method comprising: driving rotation of a valve rotor relative to a valve stator of a pulser assembly, wherein the pulser assembly comprises a housing with a motor arranged within the housing and configured to drive rotational movement of the valve rotor; and adjusting an axial gap between the valve rotor and the valve stator using an axial release assembly, including a rotational element, based on a rotation of the rotational element.

Embodiment 20: The method of any preceding embodiment, wherein adjusting the axial gap comprises at least one of: increasing the axial gap during rotation of the rotational element in a first rotational direction from an initial position and increasing the axial gap during rotation of the rotational element in a second rotational direction, opposite the first rotational direction, from the initial position, and decreasing the axial gap during rotation of the rotational element in a first rotational direction from an initial position and decreasing the axial gap during rotation of the rotational element in a second rotational direction, opposite the first rotational direction, from the initial position.

The systems and methods described herein provide various advantages. For example, embodiments provided herein enable improved and more efficient data transfer through mud pulse telemetry than prior systems and methods. For example, more defined and more easily reconstructed signals may be generated through use of angle-dependent axial release assemblies. Further, advantageously, debris and other particles may be dislodged or prevented from being stuck within a pulser assembly due to the axial movement of a valve rotor relative to a valve stator. Such axial movement may be tied to or coupled to an angle of rotation of the valve rotor and/or to a torque within the systems, such as a torque applied to a motor stator of the pulser assembly. That is, torque-dependent axial release assemblies are provided herein that provide advantages over various other pulser assemblies.

In accordance with various embodiments of the present disclosure, axial release mechanisms are implemented as part of a shear valve pulser. The axial release mechanism enables increasing a space (e.g., an axial space or axial gap) between a valve rotor and a valve stator to allow for material (e.g., particles) to flow therethrough. Such increased gap or space may reduce or eliminate plugging or blockage of the fluid flow through the pulser assembly. In accordance with some embodiments, oscillation and axial movement are mechanically coupled through the axial release mechanism/assembly, enabling a specific torque (or angle) to trigger an axial movement of the valve rotor relative to the valve stator and thus increase a gap between the valve rotor and the valve stator (e.g., to dislodge a stuck particle or other blockage).

The axial gap provided by the axial release assemblies described herein may be continuously operative, such that the axial gap changes with the oscillation (i.e., direct and continuous coupling of axial gap with rotational movement). This configuration may enable adjusting of the pulser assembly to different flow rates. For example, if a low flow is present, normally a small initial gap would be required to generate a pressure pulse, because otherwise a low-pressure drop would exist at the low flow, and only generated if the valve is almost or completely closed. However, by coupling the gap distance with the angle of rotation of the valve rotor, a large initial gap and can be employed for low flow (and close the valve completely at high angle, resulting in a small gap) for low flow only some degree (small angle results in a large gap).

Advantageously, embodiments described herein enable an axial movement of a valve rotor relative to valve stator to increase a separation gap and thus allow increased flow to dislodge or prevent blockages of the pulser assembly. The axial gap can be reduced after releasing a blockage, to ensure necessary pressure drop across the pulser assembly and to enable clean and distinct pressure pulses to be generated by the pulser assembly. A direct mechanical connection between the rotational oscillations and the axial movement is provided by the axial release assemblies described herein. Thus, a passive release (i.e., increased gap) can be achieved that is tuned to a specific torque that may occur when a blockage happens.

Further, in accordance with some embodiments, a two-way release system is also described (i.e., bi-directional rotation/oscillation), wherein the mechanism can both actively increase and decrease an axial gap between a valve rotor and a valve stator. In accordance with some embodiments, a tension spring (e.g., plate spring) can be used to preset a torque that triggers activation of the axial release assemblies described herein. The tension spring can be configured to guarantee that the valve rotor is returned to an initial position after a release of debris (i.e., after an increased gap operation is performed). In some embodiments, such as torque-dependent systems, a preset or predefined torque value can be set or controlled by a spring in a clutch mechanism. As such, a clutch can be used to activate/deactivate based on a preset torque (provided by the clutch). In some such embodiments, the clutch can be fixedly connected with a pulser housing until the preset torque is achieved, and then the clutch engages/activates to trigger the axial movement provided by the axial release mechanism.

In some embodiments, a key-slot configuration can be used to ensure that the axial movement element of the axial release assembly does not rotate during operation, but only moves or translates axially. In contrast, a rotational element of the axial release assemblies described herein may be secured axially, but free to move rotationally (e.g., in an oscillatory manner). Further, advantageously, the axial gap control can add an additional control level for pressure differentials across a pulser assembly (e.g., a smaller gap provides for higher-pressure drop across the pulser assembly).

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal-receiving device. The signal-receiving device may be a display monitor or printer for presenting the result to a user. Alternatively or in addition, the signal-receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first" and "second" do not denote a particular order, but are used to distinguish different elements.

There may be many variations or steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A pulser assembly configured to be positioned along a tubular string through which a drilling fluid flows, the pulser assembly comprising:

a housing configured to be supported along the tubular string;

a valve stator supported by the housing, the valve stator having at least one flow path that extends from an upstream end to a downstream end of the valve stator;

a valve rotor positioned adjacent the valve stator, the valve rotor configured to selectively obstruct the at least one flow path, wherein an axial gap is present between the valve rotor and the valve stator;

a motor operably coupled to the valve rotor, wherein the motor is operable to rotate the valve rotor relative to the valve stator; and an axial release assembly including a rotational element configured to adjust the axial gap between the valve rotor and the valve stator based on a torque applied to the valve rotor, further comprising a clutch assembly configured to selectively operate the axial release assembly based on the torch applied to the valve rotor.

2. The pulser assembly of claim 1, wherein the axial release assembly further comprises:

an axial movement element;

wherein rotation of the rotational element relative to the housing causes an axial movement of the axial movement element.

3. The pulser assembly of claim 2, further comprising a biasing element, the biasing element configured to bias the axial movement of the axial movement element.

4. The pulser assembly of claim 2, wherein the axial release assembly further comprises at least one rolling body arranged between the rotational element and the axial movement element.

5. The pulser assembly of claim 4, wherein:

one of the rotational element and the axial movement element comprises at least one inclined surface;

the other of the rotational element and the axial movement element comprises at least one slot; and the at least one rolling body is arranged within the at least one slot and configured to freely roll within the at least one slot along the at least one inclined surface.

6. The pulser assembly of claim 5, wherein the at least one inclined surface comprises a symmetrical configuration that includes two peaks and an inflection point located therebetween.

7. The pulser assembly of claim 2, wherein the rotational element includes a first end stop and the axial movement element includes a second end stop, wherein the first and second end stops are configured to restrict an amount of rotation of the rotational element relative to the axial movement element.

8. The pulser assembly of claim 2, wherein one of the rotational element and the axial movement element is axially constrained relative to the housing and the other of the rotational element and the axial movement element is rotationally constrained relative to the housing.

9. The pulser assembly of claim 1, wherein the motor comprises a motor stator and a motor rotor.

10. The pulser assembly of claim 9, wherein the rotational element is coupled to the motor stator.

11. The pulser assembly of claim 9, wherein the rotational element is coupled to the motor rotor.

12. The pulser assembly of claim 9, further comprising a drive shaft operably connecting the motor to the valve rotor, wherein the axial release assembly is configured to adjust an axial position of the drive shaft to adjust the axial gap between the valve rotor and the valve stator.

13. The pulser assembly of claim 12, wherein the drive shaft is axially free-coupled to the motor rotor by a sliding seat.

14. The pulser assembly of claim 1, wherein the axial release assembly is configured such that (i) a rotation of the rotational element in a first rotational direction from an initial position and a rotation of the rotational element in a second rotational direction, opposite the first rotational direction, from the initial position causes the axial gap to increase or (ii) the rotation of the rotational element in the first rotational direction from the initial position and the rotation of the rotational element in the second rotational direction, opposite the first rotational direction, from the initial position causes the axial gap to decrease.

15. The pulser assembly of claim 1, wherein the axial release assembly comprises:

a first axial movement element operably coupled to the rotational element; and a second axial movement element operably coupled to the first axial movement element;

wherein rotation of the rotational element causes an axial movement of at least one of the first axial movement element and the second axial movement element.

16. The pulser assembly of claim 15, wherein the axial release assembly is configured such that a rotation of the rotational element in a first rotational direction from an initial position causes the first axial movement element to axially move relative to the rotational element and a rotation of the rotational element in a second rotational direction, opposite the first rotational direction, from the initial position causes the second axial movement element to axial move relative to the rotational element.

17. A pulser assembly configured to be positioned along a tubular string through which a drilling fluid flows, the pulser assembly comprising:

a housing configured to be supported along the tubular string;

a valve stator supported by the housing, the valve stator having at least one flow path that extends from an upstream end to a downstream end of the valve stator;

a valve rotor positioned adjacent the valve stator, the valve rotor configured to selectively obstruct the at least one flow path, wherein an axial gap is present between the valve rotor and the valve stator;

a motor operably coupled to the valve rotor, wherein the motor is operable to rotate the valve rotor relative to the valve stator; and an axial release assembly including a rotational element configured to adjust the axial gap between the valve rotor and the valve stator based on a torque applied to the valve rotor, further comprising a gap release motor, the gap release motor configured to drive a rotation of the rotational element based on the torque applied to the valve rotor.

18. A method for generating pulses in a drilling fluid, the method comprising:

driving rotation of a valve rotor relative to a valve stator of a pulser assembly, wherein the pulser assembly comprises a housing with a motor arranged within the housing and configured to drive the rotation of the valve rotor; and adjusting an axial gap between the valve rotor and the valve stator using a clutch assembly configured to selectively operate an axial release assembly, including a rotational element, based on a torque applied to the valve rotor.

19. The method of claim 18, wherein adjusting the axial gap comprises at least one of:

increasing the axial gap during rotation of the rotational element in a first rotational direction from an initial position and increasing the axial gap during rotation of the rotational element in a second rotational direction, opposite the first rotational direction, from the initial position; and decreasing the axial gap during the rotation of the rotational element in the first rotational direction from the initial position and decreasing the axial gap during the rotation of the rotational element in the second rotational direction, opposite the first rotational direction, from the initial position.

* * * * *